US008408540B2

(12) United States Patent
Uchiyama et al.

(10) Patent No.: US 8,408,540 B2
(45) Date of Patent: Apr. 2, 2013

(54) SHEET EJECTION DEVICE, POST-PROCESSING APPARATUS AND IMAGE FORMING SYSTEM

(75) Inventors: Masaaki Uchiyama, Sagamihara (JP); Hiroyuki Wakabayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 51 days.

(21) Appl. No.: 13/069,712

(22) Filed: Mar. 23, 2011

(65) Prior Publication Data

US 2011/0233858 A1 Sep. 29, 2011

(30) Foreign Application Priority Data

Mar. 26, 2010 (JP) ..... 2010-071569

(51) Int. Cl.
*B65H 31/26* (2006.01)

(52) U.S. Cl. ..... 271/220; 271/207

(58) Field of Classification Search ..... 271/207, 271/220, 221, 224, 209; 270/58.11, 58.12, 270/58.17, 58.27
See application file for complete search history.

(56) References Cited

U.S. PATENT DOCUMENTS

| | | | | |
|---|---|---|---|---|
| 3,847,388 | A * | 11/1974 | Lynch | 271/306 |
| 5,294,107 | A * | 3/1994 | Allmendinger et al. | 271/220 |
| 6,244,583 | B1 * | 6/2001 | Ohmichi et al. | 270/58.09 |
| 6,286,829 | B1 * | 9/2001 | Emmrich | 271/220 |
| 6,412,774 | B1 * | 7/2002 | Saito et al. | 271/220 |
| 6,962,331 | B2 * | 11/2005 | Matsumoto et al. | 270/58.09 |
| 8,020,857 | B2 * | 9/2011 | Terao et al. | 271/220 |
| 2004/0201165 | A1 * | 10/2004 | Kamiya et al. | 271/220 |
| 2007/0145675 | A1 * | 6/2007 | Tamura et al. | 271/207 |
| 2008/0111295 | A1 * | 5/2008 | Tanaka et al. | 271/164 |
| 2009/0212485 | A1 * | 8/2009 | Shimizu et al. | 271/213 |
| 2011/0115153 | A1 * | 5/2011 | Uchiyama et al. | 271/213 |

FOREIGN PATENT DOCUMENTS

| | | | |
|---|---|---|---|
| JP | 01261161 | A * | 10/1989 |
| JP | 05132212 | A * | 5/1993 |
| JP | 06001517 | A * | 1/1994 |
| JP | 11-157741 | A | 6/1999 |
| JP | 2008-273656 | A | 11/2008 |

* cited by examiner

*Primary Examiner* — Prasad Gokhale
(74) *Attorney, Agent, or Firm* — Holtz, Holtz, Goodman & Chick, P.C.

(57) ABSTRACT

A sheet ejection device including: a sheet stacking section; a sheet trailing edge hitting section; a pair of sheet holding members for holding a sheet or plural sheets placed one on top of another at a sheet holding position, and moving the same to the sheet stacking position; and a friction member that is provided on one of the sheet holding members and that comes in contact with the topmost sheet of the sheets stacked on the sheet stacking section; wherein, when the sheet holding members reach the sheet stacking position, one of the sheet holding members is moved upstream in the sheet ejecting direction, whereby the trailing edge of the held sheet is made to hit against the sheet trailing edge hitting section, and the friction member comes in contact with the topmost sheet, and then the topmost sheet is biased toward the sheet trailing edge hitting section.

12 Claims, 11 Drawing Sheets

SHEET EJECTION DEVICE, POST-PROCESSING APPARATUS AND IMAGE FORMING SYSTEM

This application is based on Japanese Patent Application No. 2010-071569 filed on Mar. 26, 2010 with Japanese Patent Office, the entire content of which is hereby incorporated by reference.

BACKGROUND OF THE INVENTION

The present invention relates to a sheet ejection device for stacking sheets to be ejected, on a sheet stacking table, a post-processing apparatus and an image forming system provided with the same.

An image forming system composed of an image forming apparatus, such as a printer, copier, and the like, and post-processing device thereof are mostly equipped with a sheet loading table for temporarily storing plural sheets of paper having images formed thereon within the apparatus or equipped with a sheet ejection tray located outside the apparatus and loaded with the discharged sheet. When the sheet is discharged onto the sheet loading table or the sheet ejection tray (hereinafter, collectively referred to as a sheet stacking table), it happens that the sheet stacking position is deviated during the period after a sheet of paper leaves the sheet conveyance roller (hereinafter, referred to as an ejection roller) located immediately before the sheet stacking table and before the sheet of paper drops by its own weight onto the sheet stacking table. Consequently, there is a problem in that the sheet is not placed on the sheet stacking table in the aligned state. This problem tends to arise regardless of whether the sheet stacking table is horizontally disposed or the sheet stacking table is disposed with the loading surface thereof inclined. Particularly, this problem tends to arise when the sheet conveyance speed is high or environmental conditions are severe (high-temperature and high-humidity condition, or low-temperature and low-humidity condition). Furthermore, it is comparatively easy to align a sheet of paper by an alignment device for aligning the sheet in the direction (sheet width direction) perpendicular to the sheet conveying direction when the sheet of paper is discharged. However, it is difficult to align the sheet of paper in the sheet conveying direction. In order to improve the sheet alignment condition in the sheet conveying direction on the sheet stacking table, a variety of sheet ejection device have been developed. However, there are problems in that the mechanism is complicated and the device becomes too large, or the sheets of paper are not stacked in the aligned state.

To solve the above problems, there is disclosed a technology wherein the rear end of discharged sheet is held by a gripper, and the gripper is moved, thereby placing the sheet onto the sheet ejection tray (for example, see Japanese Patent Application Publication No. 2008-273656). The apparatus of the Japanese Patent Application Publication No. 2008-273656 has a mechanism which stacks, collected sheets in the stacker (sheet stacking table) on the ejecting tray by gripping them. The technology described in Japanese Patent Application Publication No. 2008-273656 is also advantageous because the technology can apply to stapled sheets and shift-processed sheets.

In the technique described in the Japanese Unexamined Patent Application Publication No. 2008-273656, however, it is difficult to align the trailing edges of sheets. Further, when the ejected sheet is received by a gripper, the sheet must be stopped once. A long time is required before sheets are stacked on a sheet stacking table.

In the post-processing apparatus mounted on a normal image forming system, on the other hand, post-processing operations such as binding or punching is often performed on the image-formed sheet coming out of the image forming apparatus. These post-processing operations are interlocked with the operations of the image forming apparatus. This requires a high-speed post-processing apparatus capable of conforming to the processing speed of an image forming apparatus when an image is formed on sheets at a high speed. While the sheets are subjected to post-processing operations such as binding or punching, the post-processing apparatus cannot accept the next sheet at the position (post-processing section) when post-processing operations is performed. To prevent reduction in the productivity of the sheets outputted from the image forming apparatus, the post-processing apparatus is required to accept the sheets without reducing the speed of conveying the sheets outputted from the image forming apparatus, even when post-processing operation is performed.

In one of the post-processing apparatus having been disclosed to solve the above-mentioned problem, the sheet outputted from the image forming apparatus is stopped temporarily on the upstream side of the post-processing section, and the stopped sheet and the next one are placed one on top of the other. After that, these two sheets are fed to the next post-processing section (Japanese Unexamined Patent Application Publication No. 11-157741) for example.

FIG. 13 is an overall schematic diagram of the sheet post-processing apparatus disclosed in the Japanese Unexamined Patent Application Publication No. 11-157741. According to the structure of, the Japanese Unexamined Patent Application Publication No. 11-157741, two sheets are placed one on top of the other by two branch paths 4 and 5 and a stopper located downstream. This document discloses a technique of displacement to ensure that the sheet S2 located on the upper side in the stacking section shifts forward in the direction of ejecting the sheets, when the sheets are aligned in the intermediate stacking section where the overlapped sheets S1 and S2 are temporarily accommodated The stacking section is made up of an end fence 43 and discharge belt 41.

This stacking section (sheet stacking table) is arranged in a slanted position. When the two overlapped sheets are ejected from the sheet ejection roller 24, the sheets are pushed back along the stacking section in the direction opposite to the sheet ejecting direction under its own weight and by a returning roller 45, and are aligned after coming in contact with an end fence 43 located below. When two sheets S1 and S2 are put one on top of the other and are conveyed, misalignment may occur between the two sheets S1 and S2 due to the variations in the diameter of the conveyance roller, the shape of the conveyance path or friction. If the lower sheet (first sheet) S1 shifted forward in the sheet ejecting direction is conveyed to the stacking section before reaching the stacking section, the force of returning the upper sheet by the returning roller 45 cannot be applied to the lower sheet. Thus, this sheet will be accommodated by the stacking section in a misaligned state. To solve this problem, the Japanese Unexamined Patent Application Publication No. 11-157741 provides a forced displacement to ensure that the upper sheet (second sheet) S2 shifts forward in the sheet ejecting direction. The sheet displacement is provided by changing the diameter of the conveyance roller of each branch path or the rotating speed of the conveyance roller, or by arranging stoppers at the different positions of the branch path. In the technique disclosed in the Japanese Unexamined Patent Application Publication No. 11-157741, the sheets are conveyed by being placed one on top of the other, whereby the interval of sheet conveyance is increased and a required post-processing time is provided. Thus, even during the step of post-processing, the sheets outputted from the image forming apparatus can be received by the post-processing apparatus. This arrangement allows the trailing edges of the two sheets S1 and S2 to be aligned on the stacking section.

In the technique of the Japanese Unexamined Patent Application Publication No. 11-157741, however, the mechanism section for displacing the two sheets S1 and S2 and placing one on top of the other is located far from the stacking section. Thus, these two sheets S1 and S2 are shifted before reaching the stacking section, and the original amount of displacement cannot be maintained. Further, when multiple sheets are stacked on the stacking section, the succeeding two sheets may come in contact with the sheet already stacked on the stacking section, and the sheet already stacked on the stacking section may be moved in the sheet ejecting direction.

SUMMARY

An aspect of the present invention includes the following.

1. A sheet ejection device including:

a sheet stacking section for stacking sheets ejected one by one or ejected in a form of a plurality of sheets placed one on top of another from an ejecting device;

a sheet trailing edge hitting section, against which a trailing edge in a sheet ejecting direction of a sheet stacked on the sheet stacking section is hit;

a pair of sheet holding members for holding a sheet ejected one by one or the plurality of sheets placed one on top of another at a sheet holding position, and moving the sheet or the sheets to a sheet stacking position of the sheet stacking section;

a sheet holding member moving device for moving the pair of sheet holding members from the sheet holding position to the sheet stacking position; and a friction member which is provided on one of the pair of the sheet holding members and which comes in contact with an uppermost sheet stacked on the sheet stacking section, wherein, when the pair of sheet holding members reach the sheet stacking position after holding the sheet or the sheets at the sheet holding position, the sheet holding member moving device moves the one of the sheet holding members in a direction opposite to the sheet ejecting direction so that the sheet or the sheets held by the pair of sheet holding members are moved in a direction opposite to the sheet ejecting direction and a trailing edge of the sheet or trailing edges of the sheets in the sheet ejecting direction are hit against the sheet trailing edge hitting section, and the friction member comes in contact with the uppermost sheet already stacked on the sheet stacking section so that the uppermost sheet is biased toward the sheet trailing edge hitting section located upstream in the sheet ejecting direction.

2. A post-processing apparatus including: a post-processing section for post-processing a sheet; and the sheet ejection device of Item 1 for ejecting the sheet which has been post-processed.

3. An image forming system including: an image forming section for forming an image on a sheet; and the post-processing apparatus of Item 2 for post-processing and ejecting the sheet on which an image has been formed.

DETAILED DESCRIPTION OF THE PREFERRED EMBODIMENT

Configurations and movements of the embodiments of a sheet ejection device, post-processing apparatus and image forming system related to the present invention will be described without being restricted to the embodiments thereof.

Figure 1:
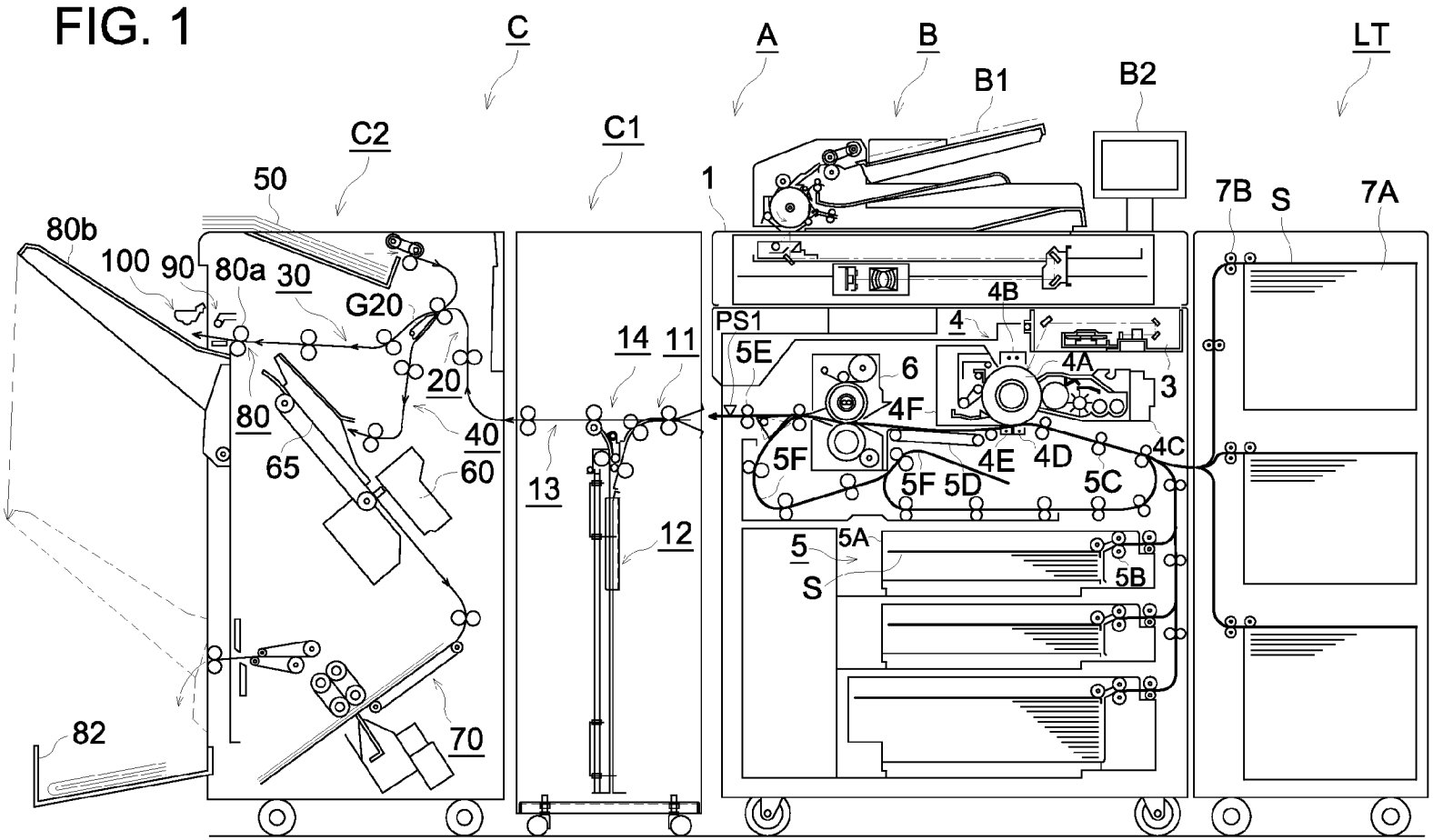
FIG. 1 is an overall schematic diagram representing an image forming system A made up of a large capacity sheet feeding device LT, an image forming apparatus B and a post-processing apparatus C.

FIG. 1 is a total configuration view of an image forming system A configured with a large capacity sheet feeding apparatus LT, an image forming apparatus B, and a post-processing apparatus C. Incidentally, the post-processing apparatus C is composed of an intermediate conveyance unit C1, and a post-processing unit C2.

[The large capacity sheet feeding apparatus LT] The large capacity sheet feeding apparatus LT is composed of a sheet stack section 7A, a first sheet feeding section 7B and others. In the sheet stack section 7A, a large amount of sheets S of A4 and A3 sizes are stored. The sheets S stored in the sheet stack section 7A are continuously sent to the image forming apparatus B.

[The image forming apparatus B] The image forming apparatus B is composed of an image reading section 1, an image writing section 3, an image forming section 4, a sheet feeding conveyance section 5, a fixing section 6, an automatic document feeding section B1, and an operation display section B2.

The image forming section 4 is composed of a photoconductive drum 4A, a charging section 4B, a developing section 4C, a transfer section 4D, a separating section 4E and a cleaning section 4F. The sheet feeding conveyance section 5 is composed of a sheet feeding cassette 5A, a first sheet feeding section 5B, a second sheet feeding section 5C, a conveyance section 5D, a sheet ejection section 5E and a automatic both side copy sheet feeding device (ADU) 5F.

An operation display section B2 is provided with a touch panel in which a touch screen is overlaid on a display section configured of a liquid crystal panel. Various setting screens can be displayed through the operation display section B2 and kinds of post-processing and kinds of the sheets stored in the sheet feeding cassette 5A can be inputted.

From a document placed on a document table of the automatic document feeding section B1, an image of one side or images on both sides are read through an optical system of the image reading section 1 and subject to photoelectric conversion to be converted to an analogue signal. The analogue signal is sent to the image writing section 3 after processing such as A/D conversion, shading correction and image compression.

The image writing section 3 scans the photoconductive drum 4A of the image forming section 4 with an output laser beam from a semiconductor and an electrostatic latent image is formed on the photoconductive drum 4A. The electrostatic latent image formed on the photoconductive drum 4A is subjected to processing such as charging, exposing, developing, transferring, separating and cleaning in the image forming section 4.

The image is transferred through a transfer section 4D onto the sheet S conveyed by the first sheet feeding section 5B and the image having been transferred onto the sheet S is fixed on the sheet S by the fixing section 6 and the sheet S on which the image has been fixed is sent to the post-processing apparatus C through a sheet ejection section 5E. When images are formed on the both sides of the sheet S, the sheet S is reversed upside down after the fixing by automatic both side copy sheet feeding device 5F and is sent to the image forming section 4 for image formation on it and then in sent to the post-processing apparatus C.

Incidentally, the image forming apparatus B in FIG. 1 is to form a monochrome image on the sheet S, it can be one which forms a color image on the sheet S.

[The post-processing apparatus C] As is mentioned above, the post-processing apparatus C is composed of an intermediate conveyance unit C1 which carries out a process to overlap sheets one another, to be described later, and the post-processing unit C2 which carries out a post-processing such as a stitching process. Incidentally, in the present embodiment, though the intermediate conveyance unit C1 and the post-processing unit C2 have independent housings, the housings can be integrated to be a single housing.

The intermediate conveyance unit C1 of the embodiment can overlap two sheets outputted from the image forming apparatus B one another at an accumulation section 12. The two overlapped sheets S1 (first sheet) and S2 (second sheet) are turned over upside down while being overlapped and conveyed to the post-processing unit C2. A sheet not to be subject to post-processing such as a stitching process or shifting process is conveyed through the sheet ejection conveyance section 30 of the post-processing unit C2 via the by-pass conveyance section 14 without passing through the accumulation section 12 and is ejected onto the elevation type sheet ejection tray 80*b* via a sheet ejection roller 80*a* as an ejecting device.

When superposed sheets S1 and S2 are subjected to shift process by the sheet alignment device 100, they are ejected onto the elevation type sheet ejection tray 80*b* from the accumulation section 12 through sheet ejection section 13, an inlet conveyance section 20, a sheet ejection conveyance section 30 and the sheet ejection roller 80*a*.

The post-processing unit C2 is provided with the inlet conveyance section 20, the sheet ejection conveyance section 30, a connection conveyance section 40, an insert sheet feeding section 50, a stitching process section 60, a stack section 65, a folding section 70, a sheet ejection mechanism section 80, a sheet ejection device 90 and the sheet alignment device 100 as a sheet alignment device. The sheet S conveyed from the connection conveyance section 40 is stacked in the stack section 65, and subject to the stitching process in the stitching process section 60. As a result, one booklet configured of plural sheets S is produced.

In the case of side stitching when the sheet bundle is stitched at one side for the stitching process, the booklet is ejected to an elevation type sheet ejection tray 80*b*, and in the case of saddle stitching where the sheet bundle is stitched at the center portion of the sheet, the sheet bundle is folded by the folding section 70 at the center and ejected to a sheet ejection tray 82.

Incidentally, though the intermediate conveyance unit C2 of the present embodiment is to perform a stitching process for plural sheets S by the stitching process section 60 or a shift process by sheet alignment device 100, it can be the post-processing device to perform application of glue onto the plural sheets S to form the booklet, or to perform a hole punching process.

The intermediate conveyance unit C1 conveys the two sheets S1 and S2 to the post-processing unit C2 after overlapping them in the accumulation section 12, thereby enabling to delay the conveyance time of sheets S to the post processing unit C2. Thus, the execution time of post-processing in the post-processing unit C2 can be acquired. As a result, decreasing of the productivity of the sheets outputted at high speed from the image forming apparatus B is obviated.

Figure 2:
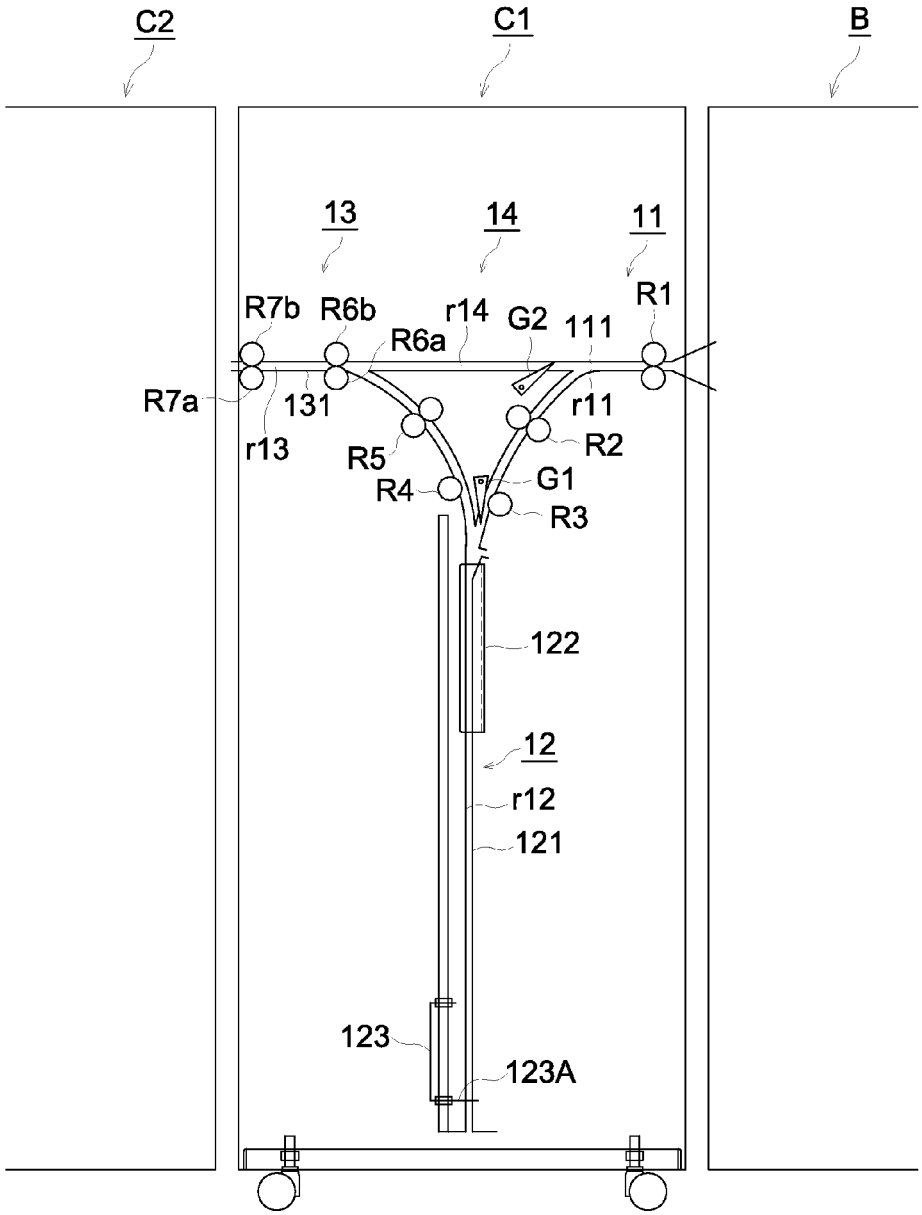
FIG. 2 is a front cross sectional view of an intermediate conveyance unit C1 for overlapping the sheets S.

[Intermediate conveyance unit C1] FIG. 2 is a front cross-sectional view of the intermediate conveyance unit C1 which superposes sheets S1 and S2 each other. The intermediate conveyance unit C1 is composed of a sheet accepting section 11, accumulation section (superposing section) 12, sheet ejection section 13, and by-pass conveyance section 14.

The sheet accepting section 11 is provided with a sheet conveyance path r11 having conveyance rollers R1 and R2 and guide plate 111. The sheet accepting section 11 subsequently accepts and conveys the sheets S ejected from the sheet ejection section 5E of the image forming apparatus B.

The accumulation section 12 is provided with two guide plates 121 disposed in parallel each other, a longitudinal aligning section configured of a stop member 123 and so forth, a lateral aligning member 122, a conveyance drive roller R3, an ejection drive roller R4 and a sheet conveyance path r12. When the stitching process is performed by the post-processing unit C2, the sheet S accepted from the sheet accepting section 11 is stored in the accumulation section 12, and ejected to upward. For a specific job in which the stitching process or the shifting process is carried out, the first sheet S1 and the second sheet S2 are overlapped in the accumulating section 12 and the two sheets having been overlapped each other are ejected upward.

The sheet ejection section 13 is provided with an intermediate conveyance roller R5, sheet ejection rollers R6*a*, R6*b*, R7*a*, and R7*b* and a sheet conveyance path r13 having a guide plate 131. In the sheet ejection section 13, the sheets S1 and S2 overlapped each other (hereinafter referred to as sheets S1 and S2 or simply sheets S) stored in the accumulation section 12 are turned over upside down and conveyed to the post-processing unit C2.

The by-pass conveyance section 14 is provided with a sheet conveyance path r14. The sheet S is conveyed to the by-pass conveyance section 14 if the sheet is not necessary to be conveyed to the accumulation section 12. For example, in the case where the stitching process or shifting process for the sheet S is not necessary or the sheet S is ejected without being turned over.

The conveyance path changeover section G2 disposed at the sheet accepting section 11 sends the sheet S to the accumulation section 12 or to the by-pass conveyance section 14. Above the accumulation section 12, a conveyance path changeover section G1 is disposed. The conveyance path changeover section G1 switches between introducing the sheet S to the accumulation section 12 and ejecting the sheet S from the accumulation section 12. The conveyance path changeover sections G1 and G2 are connected with solenoids respectively to be driven.

In the above embodiment, although it is assumed that the number of the sheets sent by the intermediate conveyance unit C1 while overlapped is two, more than two sheets overlapped are applicable.

Next, an embodiment of sheet ejection device 90 related to the present invention will be described referring to FIGS. 3*a* to 5*b*.

Figure 3A:
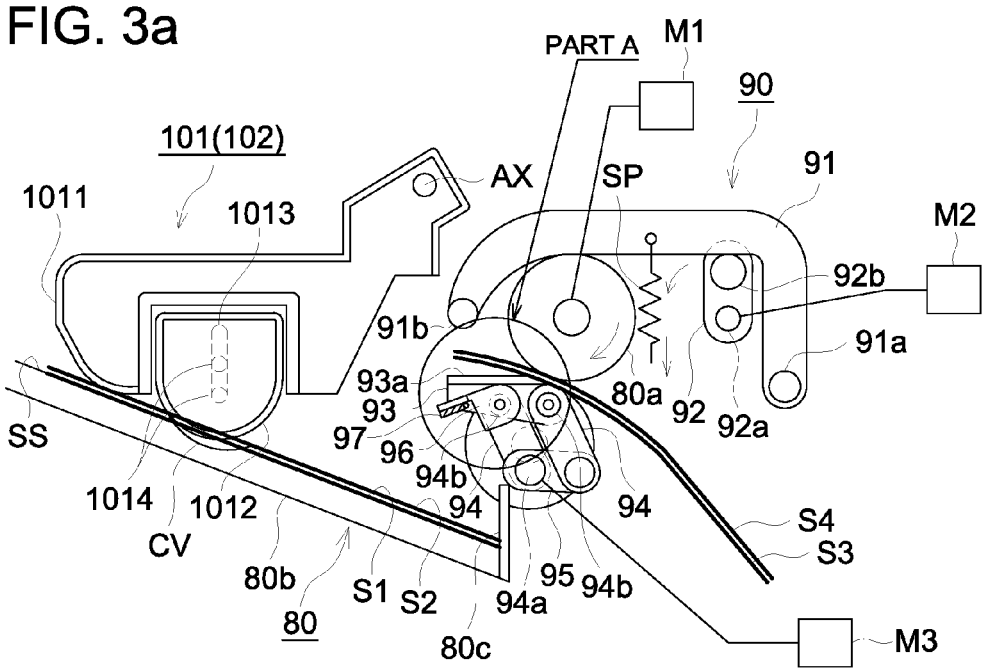
FIGS. 3*a*, 3*b* and 3*c* are schematic cross sectional views showing the configuration and operation of an embodiment of the sheet ejection device 90 in the present invention.
Figure 3B:
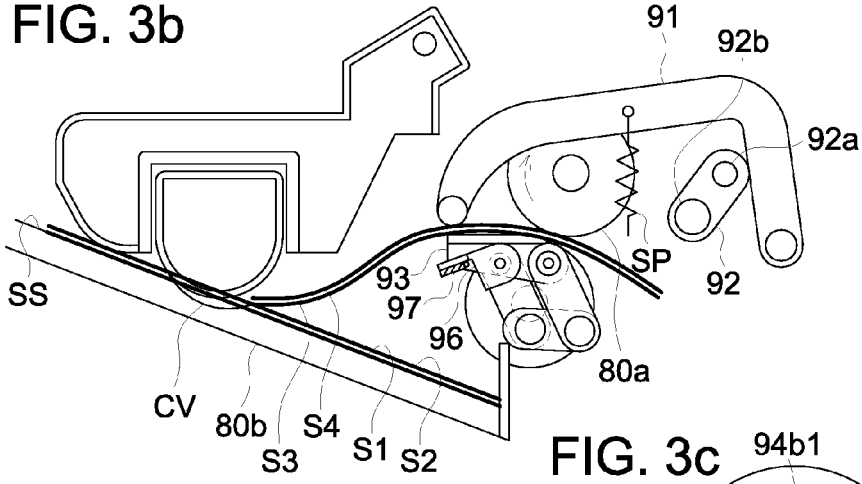
Figure 3C:
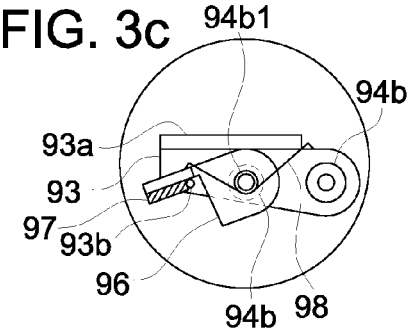
Figure 4A:
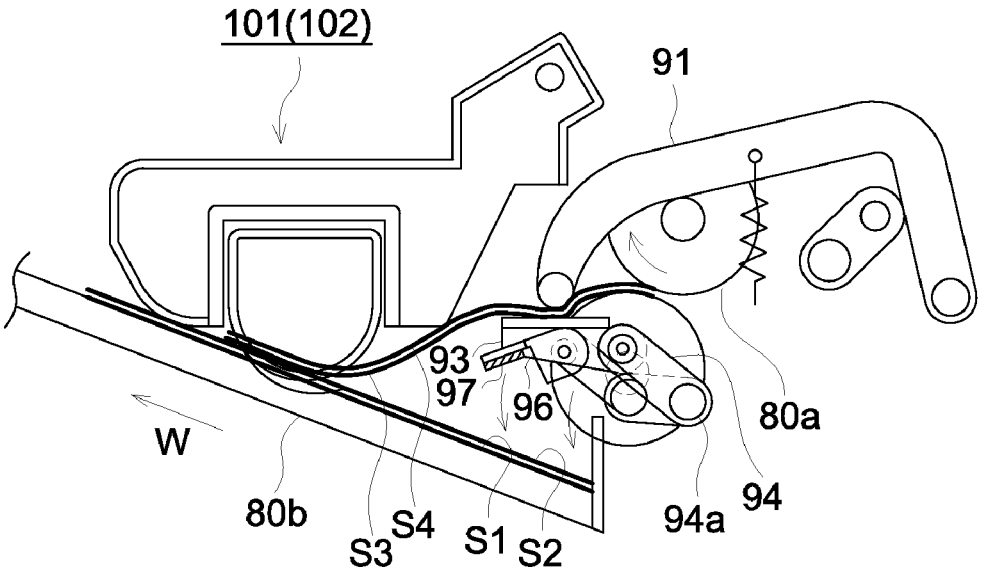
FIGS. 4*a* and 4*b* are the schematic cross sectional views showing the operation of an embodiment of the sheet ejection device 90 in the present invention.
Figure 4B:
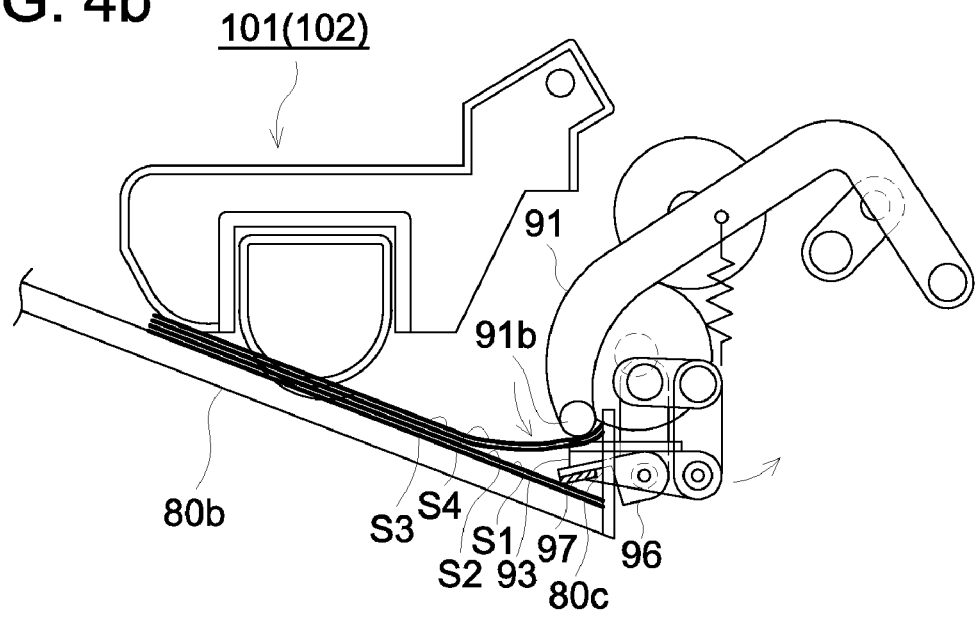
Figure 5A:
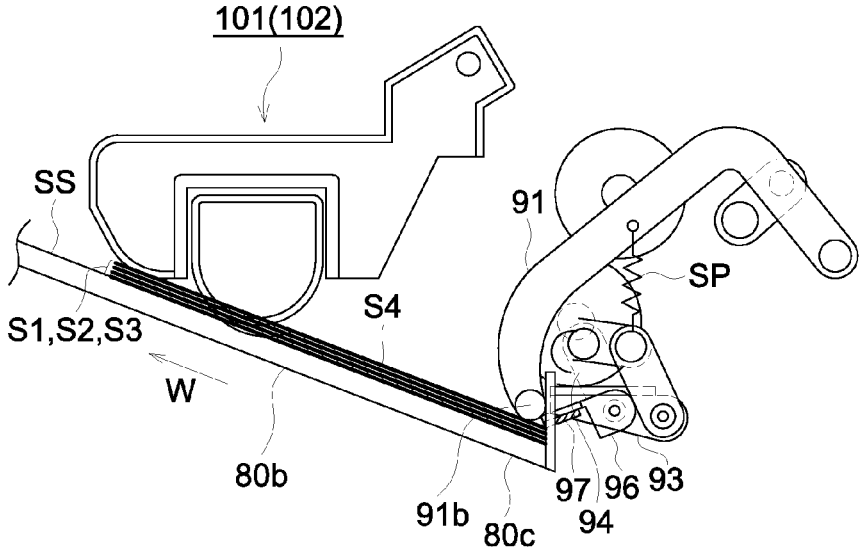
FIGS. 5*a* and 5*b* are the schematic cross sectional views showing the operation of an embodiment of the sheet ejection device 90 in the present invention.
Figure 5B:
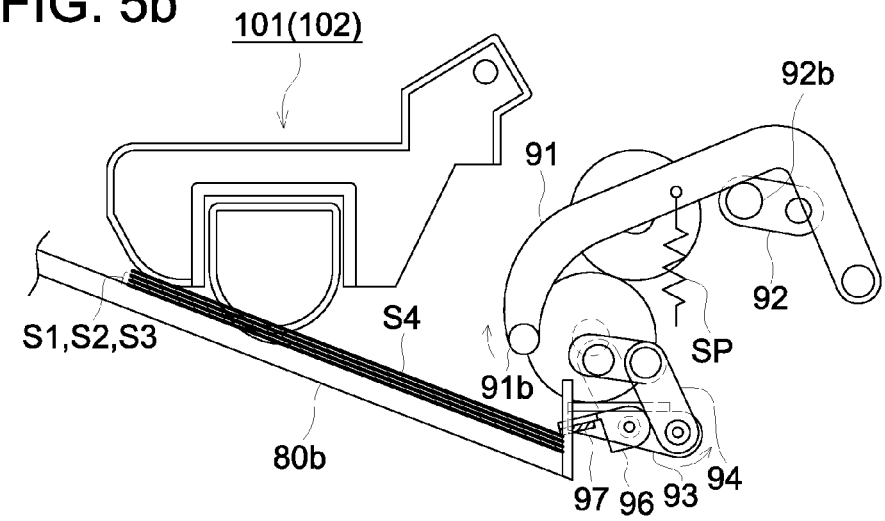

[Sheet ejection device 90] FIG. 3*a* and FIG. 3*b* are cross-sectional configuration diagrams describing the configuration and operation of an embodiment of a sheet ejection device 90 according to the present invention. FIGS. 3*a* to 5*b* are cross-sectional configuration diagrams describing the operation of an embodiment of a sheet ejection device 90 according to the present invention. FIG. 3*a* and FIG. 3*b* illustrate the situation in which the first sheet S1 and the second sheet S2 are placed on the elevation type sheet ejection tray 80*b*, and the third sheet S3 and fourth sheet S4 overlapped each other are held by the sheet ejection roller 80*a*. FIG. 4*a* and FIG. 4*b* illustrate the situation in which overlapped sheets S3 and S4 (hereinafter, referred to as S3 and S4 or simply sheets S) have passed through the sheet ejection roller 80*a* and is carried while being held by a pair of sheet holding members. Furthermore, FIG. 5*a* and FIG. 5*b* illustrate the situation after the sheets S3 and S4 has been released from the pair of sheet holding members and are placed on the elevation type sheet ejection tray 80*b*.

The sheet ejection mechanism section 80 is composed of a sheet ejection roller 80*a* as an ejecting device for discharging sheet S, an elevation type sheet ejection tray 80*b* for placing the discharged sheet S thereon, and a sheet trailing edge hitting section 80*c* for making the rear ends of the sheets S hit against it. The sheet trailing edge hitting section 80*c* becomes a reference of the sheet stacking position when the sheet S is placed on the elevation type sheet ejection tray 80*b*. Stacking surface SS functioning as a sheet stacking portion for placing sheet S is formed on the elevation type sheet ejection tray 80*b*. The sheet position detection sensor PS, not shown, is disposed upstream of the sheet ejection roller 80*a* in the sheet ejecting direction. In the embodiment, after the sheet position detection sensor PS has detected the arrival of the sheet S, rotation speed of the sheet ejection roller 80*a* is reduced in synchronized timing Reducing the rotation speed of the sheet ejection roller 80*a* ensures the reliability of the sheet discharge operation of the sheet ejection device 90. The sheet ejection roller 80*a* is connected with a speed variable sheet ejection drive motor M1 and ejects sheets S.

As shown in FIG. 3*a* to FIG. 5*b*, a pair of sheet holding members according to the present invention are composed of a sheet receiving member 93 provided below as one sheet holding member and a sheet pressure member 91 provided above as the other sheet holding member.

The sheet pressure member 91 is provided, on one end, with an engagement hole (no reference symbol assigned) for the engagement with the holding shaft 91*a* for swingably holding the sheet pressure member 91 and also provided, on the other end, with a pressure portion 91*b* for pressing, via a sheet, the sheet receiving member 93. Furthermore, a spring member SP functioning as a pressure member for pressing the sheet receiving member 93 is latched with the sheet pressure member 91 to apply a force so that the sheet pressure member 91 can swing counterclockwise. The sheet pressure member 91 pressed by the spring member SP presses the sheet receiving member 93 while holding sheet S, and swings following the moving sheet receiving member 93. The sheet pressure member 91 is separated from the sheet receiving member 93 and stands by at the retraction position above indicated in FIG. 3*a* until the sheet S approaches the sheet holding position (to be described later).

The pressure regulation device is composed of a pressure regulation member 92 for restricting the position of the sheet pressure member 91 and a pressure regulation member drive motor M2 which is forwardly and reversely rotatable for driving the pressure regulation member 92. The pressure regulation member 92 is disposed adjacent to the sheet pressure member 91. The pressure regulation member 92 is equipped with an shaft portion 92*a* connected to the pressure regulation member drive motor M2, and forward-reverse rotatably holding the pressure regulation member 92, and the engagement section 92*b* for engaging with the sheet pressure member 91. The rotation of the sheet pressure member 91 in the counterclockwise direction is regulated by engagement of the engagement section 92*b* mounted on one end of a rotating pressure regulation member 92. To be more specific, the sheet pressure member 91 biased by the spring member SP is swung by being engaged with the engagement section 92*b* of the pressure regulation member 92 that rotates in the normal or reverse direction. The pressure regulation member drive motor M2 operates synchronously with the conveyance of the sheet S detected by a sheet position detection sensor PS (not illustrated).

In the meantime, the sheet receiving member 93 is provided with a sheet holding surface 93*a* with which the pressure portion 91*b* of the sheet pressure member 91 comes in contact through the sheet S. The sheet holding surface 93*a* is provided with roughing treatment to increase the friction coefficient. The friction coefficient on the surface of the sheet holding surface 93*a* is set at a value greater than that of the pressure portion 91*b* of the sheet pressure member 91 and greater than that between sheets S. The method for increasing the friction coefficient is not restricted to roughing treatment. It is also possible to form a resin-molded component as the sheet receiving member 93 to form a great number of microscopically small protrusions on the sheet holding surface 93*a*. A separate member made up of a rubber or foamed soft resin may be bonded with the sheet holding surface 93*a*.

The sheet receiving member 93 is provided with a pair of holes (without reference numeral) that rotatably fit into a pair of shafts 94*b*. A pair of these shafts 94*b* are fixed to one end of each of a pair of receiving member rotating plates 94 that are formed to have the same dimensions and shape. A pair of rotating shafts 94*a* are fixed onto the other end of each of a pair of the receiving member rotating plates 94. A pair of the rotating shafts 94*a* are rotatably held by the holding plate 95. Further, a pair of rotating shafts 94*a* are connected with a sheet receiving member drive motor M3 as a receiving member driving device for causing respective rotation in the counterclockwise direction. The rotating operation is designed to be performed simultaneously in the same direction at the same speed. A pair of receiving member rotating plates 94 are out of alignment in the direction of rotary axis, and are arranged so that there is no mutual interference at the time of rotation.

The sheet holding member moving device according to the present invention is composed of a pair of receiving member rotating plates 94, a pair of rotating shafts 94*a* fixed to the pair of receiving member rotating plates, a holding plate 95, and a sheet receiving member drive motor M3. According to the structure of the sheet holding member moving device, the pair of receiving member rotating plates 94 simultaneously rotate at the same speed in the same direction, turning the sheet receiving member 93. The sheet holding surface 93*a* of the sheet receiving member 93 is designed to be always horizontal regardless of the rotation angle of the pair of receiving member rotating plates 94. The sheet receiving member drive motor M3 rotates the pair of receiving member rotating plates 94 once when the pair of paper holding members hold sheet S once.

In this embodiment, the sheet holding surface 93*a* is designed to be always horizontal, however the sheet holding surface 93*a* may have a fixed angle to the horizontal plane.

Because the sheet holding surface 93*a* of the sheet receiving member 93 according to the present invention is always horizontal or has a fixed angle to the horizontal plane, a pair of sheet holding members can stably and smoothly hold the sheet S.

The sheet holding member 96 includes a fitting hole (without reference numeral) that fits to the outer periphery of one step portion 94*b*1 of a pair of the aforementioned shafts 94*b*, and an arm-like portion extending outwardly from this fitting hole. The sheet holding member 96 is rotatably supported by one step portion 94*b*1 of a pair of the shafts 94*b*. To be more specific, the sheet holding member 96 is held by the sheet receiving member 93 through a pair of shafts 94*b*.

The friction plate 97 as a friction member of the present invention is formed of a material of rubber or foamed resin, and is bonded to one side of the arm-like portion of the sheet holding member 96. The friction coefficient on the surface of the friction plate 97 for coming in contact with the sheet is set at a value greater than that between plural sheets stacked on the elevation type sheet ejection tray 80*b*. Further, the step portion 94*b*1 is wound with a torsional coil spring 98. One end of the torsional coil spring 98 is engaged with the arm-like portion of the sheet holding member 96, while the other end is engaged with a portion close to the sheet holding surface 93*a* of the sheet receiving member 93 (FIG. 3*c*). The sheet holding member 96 is biased by this torsional coil spring 98 to rotate in the counterclockwise direction with respect to the sheet receiving member 93 in such a way as to permit displacement with respect to the sheet receiving member 93 of the sheet contacting surface. Further, the sheet receiving member 93 is provided with a stopper pin 93*b* to regulate the range of the rotation of the sheet holding member 96.

In the present embodiment, the friction plate 97 is bonded to the sheet holding member 96, which is held by the sheet receiving member 93 through a pair of shafts 94*b*. However, it is also possible to arrange such a configuration that the friction member is made of an elastic member such as a rubber and is fixed to the sheet receiving member 93, without a spring and others being used. To be more specific, this configuration ensures that the surface to be in contact with the sheet S is deformed by the deformation of the elastic member when the friction member presses the sheets S stacked on the elevation type sheet ejection tray 80*b*.

Since the surface of the friction plate 97 for coming in contact with the sheet S in the present invention is arranged to be displaced, the friction drag with respect to the sheet S is kept almost constant, independently of the change in the height of the elevation type sheet ejection tray 80*b*.

By setting the friction coefficient of the sheet holding surface 93*a* of the sheet receiving member 93 in the present invention at a value greater than that of the pressure portion 91*b* of the sheet pressure member 91 and greater than that between the sheets, it is easy to correct the sheet S3 being misaligned downstream of the sheet S4 in the sheet conveyance direction.

Figure 13:
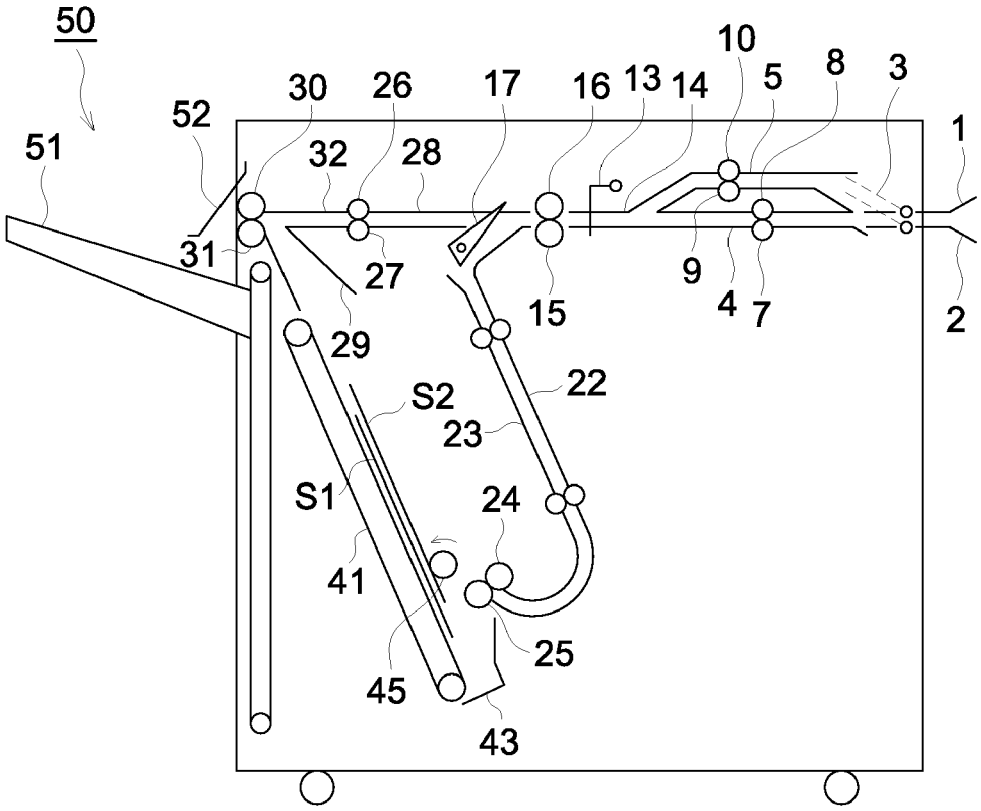
FIG. 13 is an overall schematic diagram representing the sheet post-processing apparatus described in the Japanese Unexamined Patent Application Publication No. 11-157741.

As described with reference to FIG. 13, when the sheet S4 (S2 of FIG. 13) is located above the sheet S3 (S1 of FIG. 13), the sheet S4 misaligned downstream in the sheet ejecting direction (FIG. 13) can be easily corrected by the commonly known returning roller (returning roller 45 of FIG. 13) and others. Conversely, if the sheet S4 is misaligned upstream of the sheet ejecting direction, the problem is how to correct this misalignment. This problem can be solved by the configuration of the present invention, because the friction coefficient of the sheet holding surface 93*a* is set at a value greater than that between sheets. The details will be described later with reference to FIGS. 4*a* and 4*b*.

In the meantime, the sheet ejection device 90 of the present invention is provided with a pair of alignment members 101 and 102 as sheet alignment units for aligning the position of the edge of the sheet S to be ejected to the elevation type sheet ejection tray 80*b* in a direction perpendicular to the sheet ejecting direction. A pair of alignment members 101 and 102 are arranged on the downstream side in the sheet ejecting direction of a pair of sheet holding members. The configuration and operation of a pair of alignment members 101 and 102 will be described later.

FIG. 3*a* illustrates the situation in which sheet S3 and S4 have reached the sheet ejection roller 80*a* before the sheets S3 and S4 reach the sheet holding position. FIG. 3*b* illustrates the situation in which the sheets S3 and S4 have reached the sheet holding position. Herein, the sheet holding position means the position at which sheets S3 and S4 and a pair of sheet holding members are located, at the moment when the sheet S3 and S4 are held by the pair of sheet holding members. FIG. 3*c* is the detailed figure of part A in FIG. 3*a*.

In FIG. 3*a*, when the leading edge is held by the sheet ejection roller 80*a* before the sheets S3 and S4 to be ejected reach the sheet holding position (FIG. 3*b*), the sheet receiving member 93 has been moved to the sheet holding position for holding the sheets S3 and S4, and stays on standby there. In the meantime, the sheet pressure member 91 is rotated in the clockwise direction against the biasing of the spring member SP, by the operation of the pressure regulation member 92 driven by the pressure regulation member drive motor M2, and stays on standby at a position away from the sheet receiving member 93. The pressure regulation member 92 is arranged at the position adjacent to the sheet pressure member 91. The pressure regulation member 92 is equipped with a shaft portion 92*a* for rotatably holding the pressure regulation member 92, and an engagement portion 92*b* to be engaged with the sheet pressure member 91. The shaft portion 92*a* is connected with the pressure regulation member drive motor M2 capable of rotating in the normal or reverse direction. This arrangement allows the pressure regulation member 92 to be rotated in the clockwise direction by the normal rotation of the pressure regulation member drive motor M2, and in the counterclockwise direction by the reverse rotation. When the leading edges of the sheets S3 and S4 are held by the sheet ejection roller 80*a*, the rotating speed of the sheet ejection drive motor M1 connected to the sheet ejection roller 80*a* is reduced.

In FIG. 3*b*, when sheets S3 and S4 reach the sheet holding position, the pressure regulation member 92 rotates in a counterclockwise direction in synchronization with the detection by the sheet position detection sensor PS, not shown, to detect the sheets S3 and S4, and the rotation restriction of the engaged sheet pressure member 91 is released. When the rotation restriction has been released, the sheet pressure member 91 is rotated in a counterclockwise direction by the biasing of the spring member SP, thereby coming in contact with and pressing the sheet receiving member 93 while holding rear end portions of the sheets S3 and S4 which have reached the sheet holding position.

Regarding the sheet receiving member 93 staying on standby at the sheet holding position, the sheet receiving member drive motor M3 is rotated after the lapse of a prescribed time subsequent to detection of the sheets S3 and S4 by the sheet position detection sensor PS. The movement is started by the rotation of a pair of the receiving member rotating plates 94 connected thereto. The sheet pressure member 91 pressing the sheet receiving member 93, with the sheets S3 and S4 being held therebetween, moves in conformity to the movement of sheet receiving member 93. The sheets S3 and S4 is conveyed by the sheet ejection roller 80*a* during the time from holding of the sheets S3 and S4 between the sheet pressure member 91 and sheet receiving member 93 at the sheet holding position to the ejection of the trailing edges of the sheets S3 and S4 from the sheet ejection roller 80*a*. To be more specific, the sheets S3 and S4 conveyed during this time slip between the sheet pressure member 91 and sheet receiving member 93.

According to the present invention, while the rear end portion of the sheets S3 and S4 are held by the sheet ejection roller 80*a*, and are conveyed, the sheets S3 and S4 get held by a pair of the sheet holding members at the sheet holding position. This ensures a secure transfer of the sheets without any need of stopping the sheets S3 and S4 during the sheet conveyance, with the result that the efficiency is enhanced.

In FIG. 3*b*, the sheets S3 and S4 with the rear end portions thereof (closer to the trailing edge than the sheet central position) held by a pair of sheet holding members are conveyed to the elevation type sheet ejection tray 80*b* where a pair of alignment members 101 and 102 (to be described later) having been moved to the position for coming in contact with the sheet are placed on standby.

As described in FIG. 3*a*, the sheet ejection device 90 of the present invention is equipped with a pair of alignment members 101 and 102. A cavity CV is formed on the surface corresponding to the position where the alignment member 101 (102) is arranged in the elevation type sheet ejection tray 80*b*.

Referring to FIGS. 4*a* and 4*b*, the following describes the flow of the procedure from the arrival of the sheets S3 and S4 at the sheet holding position to the arrival at the elevation type sheet ejection tray 80*b* caused by the sheet ejection device 90 of the present invention.

FIGS. 4*a* and 4*b* are the schematic cross sectional views showing the operation of an embodiment of the sheet ejection device 90 in the present invention. To put it more specifically, these views show the movement of the sheets S3 and S4 held by a pair of sheet holding members from when the sheets S3 and S4 pass through the sheet ejection roller 80*a* till when they reach the sheet stacking position.

FIG. 4*a* illustrates the situation at the time when the rear end of sheets S3 and S4 departs from the nip portion of the sheet ejection roller 80*a*. FIG. 4*b* illustrates the situation in which sheets S3 and S4 have reached the sheet stacking position and the rear ends of the sheets S3 and S4 hit against the sheet trailing edge hitting section 80*c* and the friction plate 97 is in contact with the upper surface of sheet S2 placed on the elevation type sheet ejection tray 80*b*.

In FIG. 4*a*, when the rear end of sheet S3 and S4 depart from the nip portion of the sheet ejection roller 80*a*, the force of the sheet ejection roller 80*a* to carry the sheet S3 and S4 disappears. That is, the sheets S3 and S4 moves according to the movement of the sheet receiving member 93 while the sheets S3 and S4 are being held by the sheet pressure member 91 and sheet receiving member 93. Rotation of the sheet receiving member drive motor M3, not shown, rotates a pair of receiving member rotating plates 94 via a pair of rotating shafts 94*a* coupled to the motor M3, thereby turning the sheet receiving member 93 counterclockwise.

In FIG. 4*b*, when sheets S3 and S4 have reached the sheet stacking position, the sheet receiving member 93 is moved upstream departing from the sheet pressure member 91 in the direction opposite to the sheet conveying direction by the rotation of the sheet receiving member drive motor M3. Because of the movement of the sheet receiving member 93, the rear ends of the sheets S3 and S4 hit against the sheet trailing edge hitting section 80*c* and stop. Herein, the sheet stacking position means the positions of the sheet S and a pair of sheet holding members at the time when the bottom surface of the sheet S comes in contact with the stacking surface SS formed on the elevation type sheet ejection tray 80*b*, and the rear end of the sheet S hits against the sheet trailing edge hitting section 80*c* which is a reference of the loading position.

In this case, when there is misalignment between the sheet S3 and sheet S4 and the upper sheet S4 is misaligned upstream in the sheet ejecting direction, the sheet S3 is moved by the movement of the sheet receiving member 93 in the direction opposite to sheet ejecting direction, whereby the misalignment with respect to the sheet S4 can be corrected. To be more specific, since the friction coefficient of the sheet holding surface 93*a* of the sheet receiving member 93 is greater than that of the pressure portion 91*b* of the sheet pressure member 91, the trailing edge of the sheet S4 is first brought in contact with the sheet trailing edge hitting section 80*c* by the movement of the sheet receiving member 93. Then, since the friction coefficient of the sheet holding surface 93*a* is greater than that between the sheets, a shift is produced between the sheet S3 and sheet S4 by the movement of the sheet receiving member 93. Thus, the trailing edge of the sheet S3 in the sheet ejecting direction is moved to hit against the sheet trailing edge hitting section 80*c*, and the trailing edges of the sheets S3 and S4 hit against the sheet trailing edge hitting section 80*c* to be aligned.

In the meantime, when the upper sheet S4 is misaligned downstream in the sheet ejecting direction, the trailing edge of the sheet S3 is first brought to hit against the sheet trailing edge hitting section 80*c* by the movement of the sheet receiving member 93 in the direction opposite to the sheet ejecting direction. Thus misalignment cannot be possibly corrected by any attempt to move the sheet S3. In this case, misalignment of the sheet S4 can be corrected by the action making the friction plate 97 (to be described later) to come in contact with the sheet S4 in the next cycle of the rotation of the sheet receiving member 93 (at the time of ejection of the fifth and sixth sheets S5 and S6).

Similarly, when the stacked sheet S2 on the elevation type sheet ejection tray 80*b* is misaligned downstream in the sheet ejecting direction, the misalignment can be corrected by the action making the friction plate 97 to come in contact with the sheet S2. To be more specific, the friction plate 97 arranged on the sheet holding member 96 is made to come in contact with the top surface of the sheet S2 by the rotation of the sheet receiving member 93 holding the sheets S3 and S4. Then the sheet S2 is biased upstream in the sheet ejecting direction, with the result that the trailing edge of the sheet hits against the sheet trailing edge hitting section 80*c*.

The sheet ejection device 90 of the present invention is applicable not only to one sheet but also to two or more sheets in a bound or folded form. The greatest effect will be gained when two sheets S are held by a pair of sheet holding members. To be more specific, when two sheets S are held, the sheet is certainly moved upstream by the friction of the sheet holding surface 93*a* of the sheet receiving member 93 if the lower sheet is misaligned downstream in the sheet ejecting direction, and by the friction of the friction plate 97 if the upper sheet is misaligned downstream in the sheet ejecting direction.

By movement of the sheet receiving member 93 of the present invention in the direction reverse to the sheet ejecting direction at the sheet stacking position, the trailing edges of the sheets S3 and S4 comes in contact with the sheet trailing edge hitting section 80*c*, and the alignment of the sheets at the sheet stacking position is enhanced. Further, when the sheet pressure member 91 of the present invention presses the sheets S3 and S4 against the stacking surface SS of the elevation type sheet ejection tray 80*b* at the sheet stacking position, the state of sheet stacking is enhanced.

Further, by arranging the sheet receiving member 93 and friction plate 97 of the present invention and setting the friction coefficient, misalignment can be corrected by the effect of the sheet holding surface 93*a* of the sheet receiving member 93 or friction plate 97 upon the sheet S, even if the sheets S3 and S4 held by the sheet holding member are misaligned. When the lower sheet S1 or S3 of the sheets S1 and S2 or S3 and S4, placed one on top of the other, is misaligned downstream in the sheet ejecting direction, misalignment can be corrected by the effect of the sheet receiving member 93. When the upper sheet S2 or S4 is misaligned downstream in the sheet ejecting direction, misalignment can be corrected by the effect of the friction plate 97.

Because the sheet does not drop by its own weight but is held by a pair of sheet holding members according to the present invention and guided to the stacking surface SS, it is possible to reduce the time to load the sheet onto the stacking surface SS and also ensure reliable stacking. Furthermore, because sheet S1 is held while the sheets S3 and S4 are carried to be discharged by the sheet ejection roller 80*a*, it is possible to reduce the time more to load the sheet onto the stacking surface SS and also make the operation stable. Furthermore, because a pair of sheet holding members hold the rear end portion of the sheets S3 and S4 and the sheet pressure member 91 moves from a sufficiently distant location and holds the sheets S3 and S4, the sheet holding operation can be stable even if there is curling, ruffling of the operation, position deviation of the sheets S3 and S4, or the like.

Referring to FIGS. 5*a* and 5*b*, the following describes the flow of procedure from the arrival of the sheets S3 and S4 at the sheet stacking position, to the completion of these sheets being stacked in position in the sheet ejection device 90 of the present invention.

FIGS. 5*a* and 5*b* are the schematic cross sectional views showing the operation of an embodiment of the sheet ejection device 90 in the present invention. These figures show the sheets S3 and S4 after having been released from a pair of the sheet holding members and stacked on the elevation type sheet ejection tray 80*b*.

In FIG. 5*a*, the sheet pressure member 91 having been separated from the sheet receiving member 93 by the rotational of the receiving member rotating plate 94 is biased by the spring member SP, and presses the sheets S3 and S4 against the stacking surface SS of the elevation type sheet ejection tray 80*b* while the trailing edges of the sheets S3 and S4 are kept in contact with the sheet trailing edge hitting section 80*c*. Under this condition, the sheets S3 and S4 have been completely stacked onto the elevation type sheet ejection tray 80*b*.

As described with reference to FIGS. 4*a* and 4*b*, the friction plate 97 bonded to the sheet holding member 96 is made to come in contact the sheet S2 and to move by the rotation of the sheet receiving member 93, with the result that the trailing edge of the sheet S2 stacked on the elevation type sheet ejection tray 80*b* hits against the sheet trailing edge hitting section 80*c*.

In FIG. 5*b*, after counting of a timer not illustrated, the normal rotation of the pressure regulation member drive motor M2 rotates the pressure regulation member 92 clockwise resisting against the force of the spring member SP, and the pressing portion 91*b* of the sheet pressure member 91 departs from the sheet S4. After that, the sheet pressure member 91 is returned to the retraction position shown in FIG. 3*a*. The rotation of the sheet receiving member drive motor M3 rotates the pair of receiving member rotating plates 94 counterclockwise and returns the sheet receiving member 93 to the sheet holding position, and then, the condition shown in FIG. 3*a* is restored.

When the pressure portion 91*b* of the sheet pressure member 91 of FIG. 5*b* moves away from the sheet S4, the sheet S4 may be raised by following the rise of the pressure portion 91*b*. This is mainly caused by static electricity produced between the sheet pressure member 91 and sheet S4. The frequency of the occurrence of this static electricity varies according to the environmental conditions such as humidity, sheet material or the number of sheets to be printed on a continuous basis. This problem of the sheet S4 being raised by the rise of the pressure portion 91*b* can be solved by effectively utilizing the operation holding the end of the sheet S with a pair of alignment members 101 and 102 which align the ends of the sheet in the direction perpendicular to ejecting direction of the sheet S. A specific configuration and operation for preventing the sheet S4 from being raised will be described later.

As will be described later, the alignment drive motor M4 for driving the alignment operation of a pair of alignment members 101 and 102 of the present invention starts the operation for alignment simultaneously or immediately before the pressure regulation member drive motor M2 starts normal rotation. Since the alignment drive motor M4 starts the operation for alignment simultaneously or immediately before the normal rotation of the pressure regulation member drive motor M2 starts, a pair of alignment members 101 and 102 come in contact with the sheet S simultaneously or immediately before the sheet pressure member 91 is separated from the sheet S4 to prevent the sheet S4 from being raised.

Further, the sheet pressure member 91 presses the sheets S1, S2, S3 and S4 against the stacking surface SS of the elevation type sheet ejection tray 80*b* at the sheet stacking position. This improves the state of sheet stacking.

In the present embodiment, the friction plate 97 is bonded to the sheet holding member 96 which is rotatably supported, and the sheet holding member 96 is biased by the torsional coil spring 98. However, it is also possible to arrange such a configuration that the sheet holding member 96 or torsional coil spring 98 are not used. To be more specific, the friction plate 97 is formed of the deformable material such as a rubber plate or foamed resin block and is bonded to the sheet receiving member 93 in such a way that the rear end of the sheet S2 on the elevation type sheet ejection tray 80*b* can hit against the sheet trailing edge hitting section 80*c* in conformity to the movement of the sheet receiving member 93. Since the friction plate 97 is made of a rubber plate or foamed resin block, the surface of the friction plate 97 coming in contact with the sheet is made displaceable. This allows the sheet S to hit against the sheet trailing edge hitting section 80*c*, independently of variations in the sheet height.

The friction coefficient of the friction plate 97 of the present invention is greater than that between the sheets, and the friction plate 97 comes in contact with the top surface of the sheet S2 so that the trailing edge of the sheet hits against the sheet trailing edge hitting section 80*c*. This arrangement improves the stacking of the sheet S2 already stacked. Moreover, without falling under its own weight, the sheets are held by a pair of sheet holding members and are guided to the stacking surface SS. This arrangement reduces the time of stacking the sheets on the stacking surface SS and ensures stable stacking operation. Further, the sheets S3 and S4 are held during the time of ejection and conveyance by the sheet ejection roller 80*a*. This configuration reduces the time for stacking the sheets on the stacking surface SS and ensures more stable operation of the conveyance. Moreover, the middle portion of the sheet S is held by a pair of sheet holding members and the sheet pressure member 91 is moved from a location sufficiently far away to hold the sheet S. This procedure ensures the sheet S to be held, despite possible curling, waviness or positional displacement of the sheet S. Further, a sheet alignment device 100 is provided in the embodiment of the sheet ejection device 90. This ensures that the sheets S loaded on the elevation type sheet ejection tray 80*b* have the ends uniformly aligned in the longitudinal and transverse directions, and eliminates the possibility of the sheet S being raised by the rise of the sheet pressure member 91.

In the present embodiment, two sheets S have been described to be held by a pair of sheet holding members. The present invention is also applicable to the case of one sheet or overlapped plural sheets more than one sheet being ejected.

Referring to FIGS. 6 through 8*b*, the following describes the configuration and operation in an embodiment of a sheet alignment device 100 as the sheet alignment device of the present invention.

Figure 6:
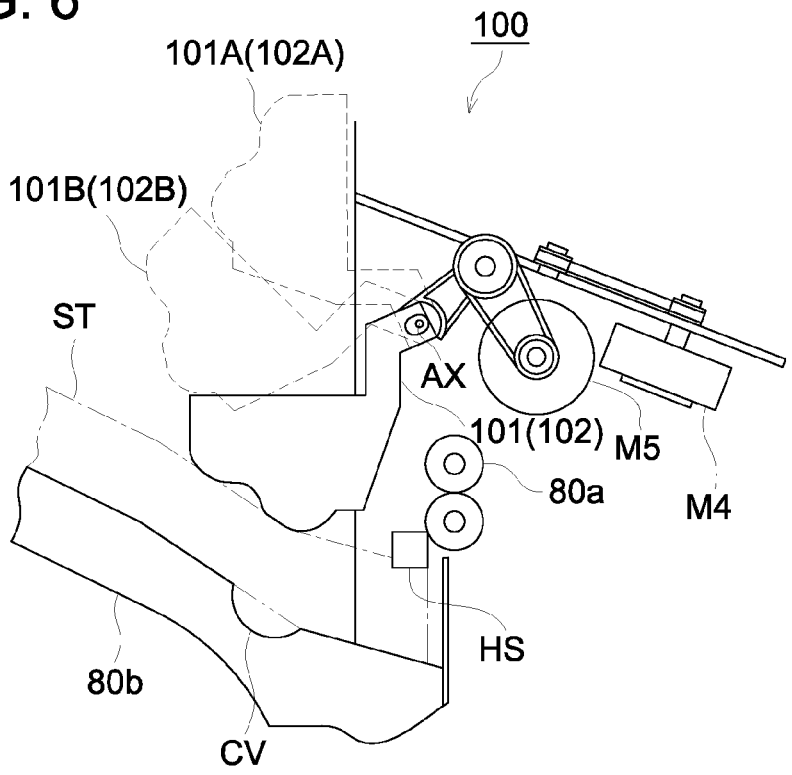
FIG. 6 is a schematic configuration diagram representing the operation of the sheet alignment device 100 in the present invention.
Figure 7:
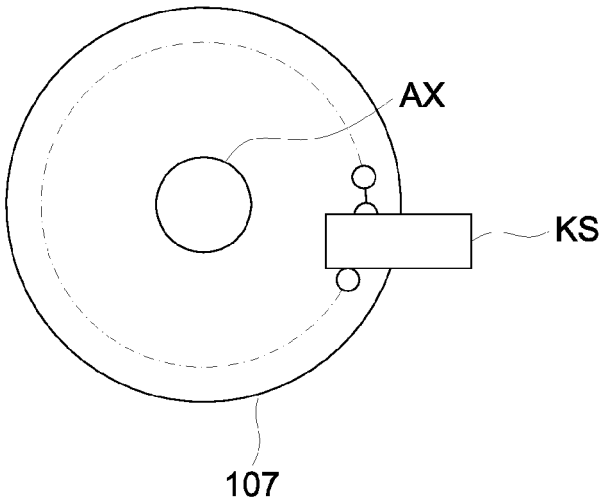
FIG. 7 is a schematic view showing the mechanism of the detecting unit for detecting the position of the alignment members 101 and 102 along the height.
Figure 8A:
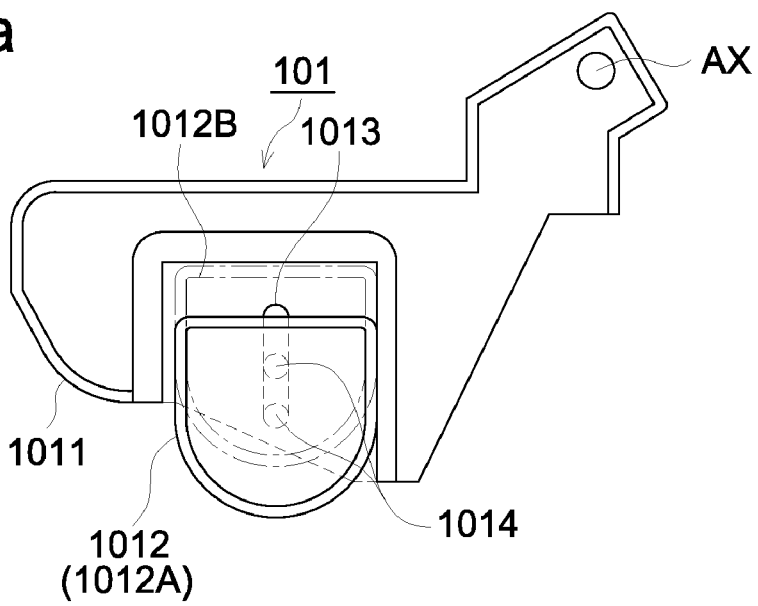
FIGS. 8*a* and 8*b* are enlarged views representing the alignment member 101 (102) in the present invention, at the portion indicated by the solid line of FIG. 6.
Figure 8B:
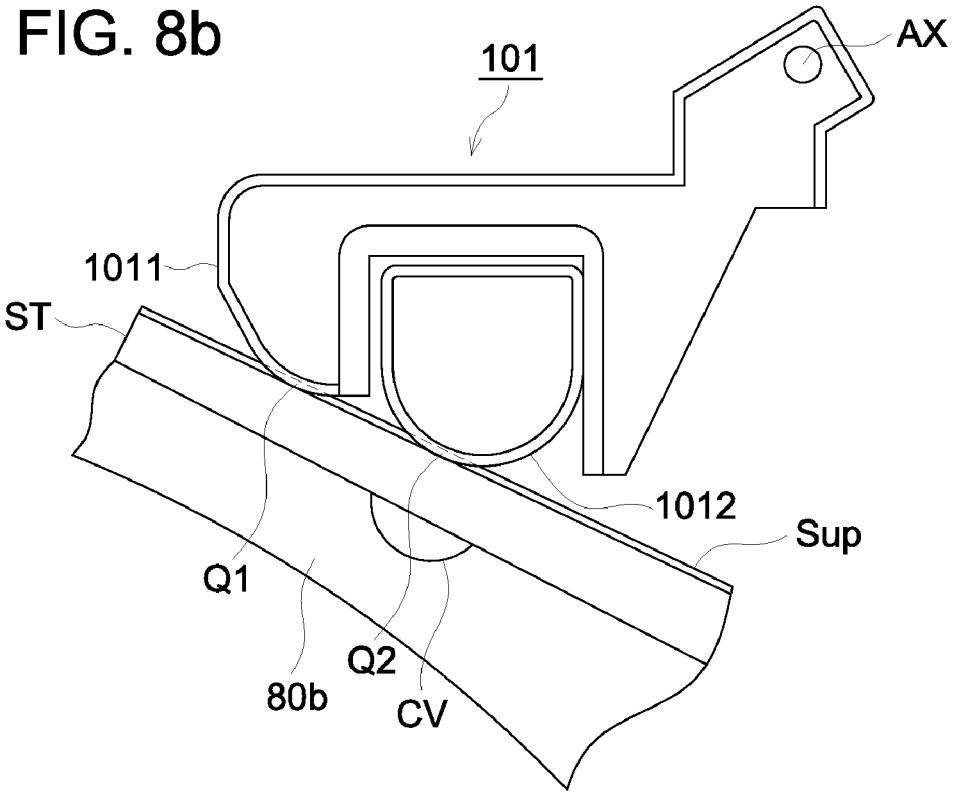

FIG. 6 is a schematic configuration diagram representing the operation of the sheet alignment device 100 in the present invention. FIG. 7 is a schematic view showing the mechanism of the detecting device for detecting the position of the alignment members 101 and 102 in the height direction. FIGS. 8*a* and 8*b* are enlarged views representing the alignment member 101 (102) in the present invention, indicated by the solid line of FIG. 6.

As shown in FIG. 3*a*, the embodiment of the sheet ejection device 90 of the present invention includes a pair of alignment members 101 and 102 (102 is not illustrated) arranged in the sheet alignment device 100. The cavity CV formed on the surface of the elevation type sheet ejection tray 80*b* is arranged immediately below the alignment member 101 (102). The function thereof will be described later.

As shown in FIG. 6, the sheet alignment device 100 as a sheet alignment unit in the present invention includes a pair of alignment members 101 and 102, alignment drive motor M4 as an alignment drive device, and an alignment member retraction drive motor M5.

As described above, the sheet S ejected from the sheet ejection roller 80*a* is fed onto the elevation type sheet ejection tray 80*b*. In FIG. 6, plural sheets S are shown being stacked to form a sheet bundle ST. The top surface of the sheet bundle ST is detected by the height detecting sensor HS made up of a photoelectric sensor. If there is an increase in the number of the stacked sheets S, the elevation type sheet ejection tray 80*b* is lowered accordingly. The elevation type sheet ejection tray 80*b* moves in the vertical direction to ensure that the top surface of the sheet bundle ST is kept constant at all times. Such a vertical movement of the elevation type sheet ejection tray 80*b* is driven by the motor (not illustrated) under the control of a control device 110 (to be described later).

When the sheet bundle ST is stacked on the elevation type sheet ejection tray 80*b*, a gap formed between the sheet bundle S and elevation type sheet ejection tray 80*b* by the cavity CV, as shown in the figure. When the sheet bundle ST is taken out of the elevation type sheet ejection tray 80*b* by the operator, it can be taken out easily by putting a hand in the gap formed by the cavity CV.

A pair of alignment members 101 and 102 of tabular shape is arranged above the elevation type sheet ejection tray 80*b*. These alignment members 101 and 102 serve the function of aligning the end positions in the width direction of the sheet bundle ST and are so arranged as to be separated from each other across the width and to be opposed to each other. The alignment members 101 and 102 are arranged rotatably around the rotary axis AX in such a way that they can be touched and detached from the elevation type sheet ejection tray 80*b*. The alignment members 101 and 102 are set at the alignment position indicated by a solid line, the first retraction position (101A, 102A) indicated by a dotted line, and the second retraction position (101B, 102B) also indicated by a dotted line. The rotation of the alignment members 101 and 102 are driven by the alignment member retraction drive motor M5, and are set at any one of the alignment position, the first retraction position and the second retraction position.

In FIG. 6, the solid line indicates the alignment position after a great number of sheets S have been ejected and stacked on the elevation type sheet ejection tray 80*b* to form a sheet bundle ST and alignment members 101 and 102 have been moved for shifting across the width of the sheets of the sheet bundle ST. One of the alignment members 101 and 102 in this case is mounted on the sheet bundle ST by its own weight. The other alignment member is stopped in the state of being kept in contact with the elevation type sheet ejection tray 80*b*, or is suspended in the air, according to the thickness of the sheet bundle ST stacked on the elevation type sheet ejection tray 80*b* (refer to FIG. 10).

As will be described later the alignment members 101 and 102 are moved across the width of the sheet of the sheet bundle ST. This movement is given when the driving force of the alignment drive motor M4 is transmitted to the alignment members 101 and 102 by a commonly known transmission mechanism using a belt and pulley. Such a motor as a stepping motor whose rotating angle can be set at a desired value is used as the alignment drive motor M4. This motor permits the alignment members 101 and 102 to be stopped at any positions. Further, the alignment member 101 and alignment member 102 are connected to different alignment drive motors M4 to allow mutually independent operations to be performed.

Simultaneously or immediately before the sheets S are stacked on the elevation type sheet ejection tray 80*b*, and the sheet pressure member 91 is removed from the sheet S, the alignment members 101 and 102 keep in contact with both ends of the sheet in the direction perpendicular to the ejecting direction of the sheet S for a prescribed period of time, and then aligning operation is performed. The contact with the sheet S is provided to ensure that, when the sheet pressure member 91 is removed from the sheet S, the sheet S is not be raised by the rise of the sheet pressure member 91. A prescribed period of time for keeping in contact is in the range of 0.5 through 3 seconds in the present embodiment as a satisfactory result. This period of time kept in the range of 1 through 2 seconds provides a more positive means for preventing the sheet from being raised, and reduces a loss time in stopping.

In the present embodiment, the alignment members 101 and 102 are kept in contact with the both ends of the sheet S for a prescribed period of time, before alignment operation is started. The present inventors have conducted a test, as another embodiment, to make sure that the aforementioned rise of the sheet accompanying the rise of the sheet pressure member can be prevented by normal alignment operation alone, without using the process of the contact.

Further, the present inventors have conducted a test, as still another embodiment to make sure that the aforementioned rise of the sheet accompanying the rise of the sheet pressure member can be prevented by changing the proportion of the time for keeping in contact with the sheet S with respect to the time for separation therefrom at the time of alignment by the alignment member 101 or 102. To be more specific, normally, the time for keeping in contact with the sheet S and the time for separation therefrom are each set at one second. However, in this test, the time for keeping in contact with the sheet S was set longer than the time for separation. Satisfactory results were obtained when the time for keeping in contact with the sheet S was set at a value ranging from 0.6 through 0.9 seconds, and the time for separation was set at a value ranging from 0.1 through 0.4 seconds.

The rotary positions of the alignment members 101 and 102, especially the alignment position and the first and second retraction positions are set in conformity to the signal outputted from the rotation angle detection sensor KS made up of a photoelectric sensor (FIG. 7).

In FIG. 7, an encoder 107 is fixed onto the rotary axis AX of the alignment members 101 and 102. The rotary position of the encoder 107 is detected by the rotation angle detection sensor KS. The control device 110 (to be described later) having received the detection signal causes the alignment member retraction drive motor M5 to operate, so that the alignment position, the first or second retraction positions of the alignment members 101 and 102 is set.

In FIGS. 8*a* and 8*b*, the alignment member 101 includes a first alignment member 1011 supported rotatably around the axis AX, and a second alignment member 1012 supported by the first alignment member 1011. The second alignment member 1012 is arranged inside the recess portion of the first alignment member 1011, and is slidable with reference to the first alignment member 1011 between the position indicated by 1012A and the position indicated by 1012B. The first alignment member 1011 is provided with a slit 1013 which is engaged with the pin 1014 arranged on the second alignment member 1012. Guided by the slit 1013 and pin 1014, the second alignment member 1012 travels in the vertical direction with reference to the first alignment member 1011. The alignment member 102 has a first alignment member 1021 and a second alignment member 1022 supported by the first alignment member 1021, similarly to the alignment member 101.

FIG. 8*a* shows the state when the alignment member 101 is not in contact with the elevation type sheet ejection tray 80*b* or the top surface of the sheet bundle ST placed on the elevation type sheet ejection tray 80*b*. In this case, the second alignment member 1012 is lowered to the bottommost position by its own weight. FIG. 8*b* shows the state when the alignment member 101 is on the sheet bundle ST on the elevation type sheet ejection tray 80*b*.

As shown in FIG. 8*b*, when the alignment member 101 is placed on the stop surface of the sheet bundle ST, the first alignment member 1011 and the second alignment member 1012 are always kept in contact with the sheet bundle ST on the elevation type sheet ejection tray 80*b* at two points, independently of whether the sheets are curled or not. That is, the alignment member 101 acts on the sheet Sup ejected and placed on the sheet bundle ST in such a way that the bottom end of the first alignment member 1011 regulates the edge of the sheet Sup at point Q1, and the bottom end of the second alignment member 1012 regulates the edge of the sheet Sup at point Q2 (refer to FIG. 9).

As shown in FIGS. 8*a* and 8*b*, the first alignment member 1011 and second alignment member 1012 are designed in such a way that their leading edges (the bottom ends) which come in contact with the sheet bundle ST are formed in a gentle circular arc. Thus, when a sheet S is placed and is aligned on the sheet bundle ST stacked on the elevation type sheet ejection tray 80*b*, the width of the regulated position with respect to the sheet S is the minimum for the first sheet. The width of the regulated position is increased for the sheet that comes later. As has been described, alignment precision for the first sheet is enhanced. The alignment precision for the succeeding sheets is further improved.

Figure 9:
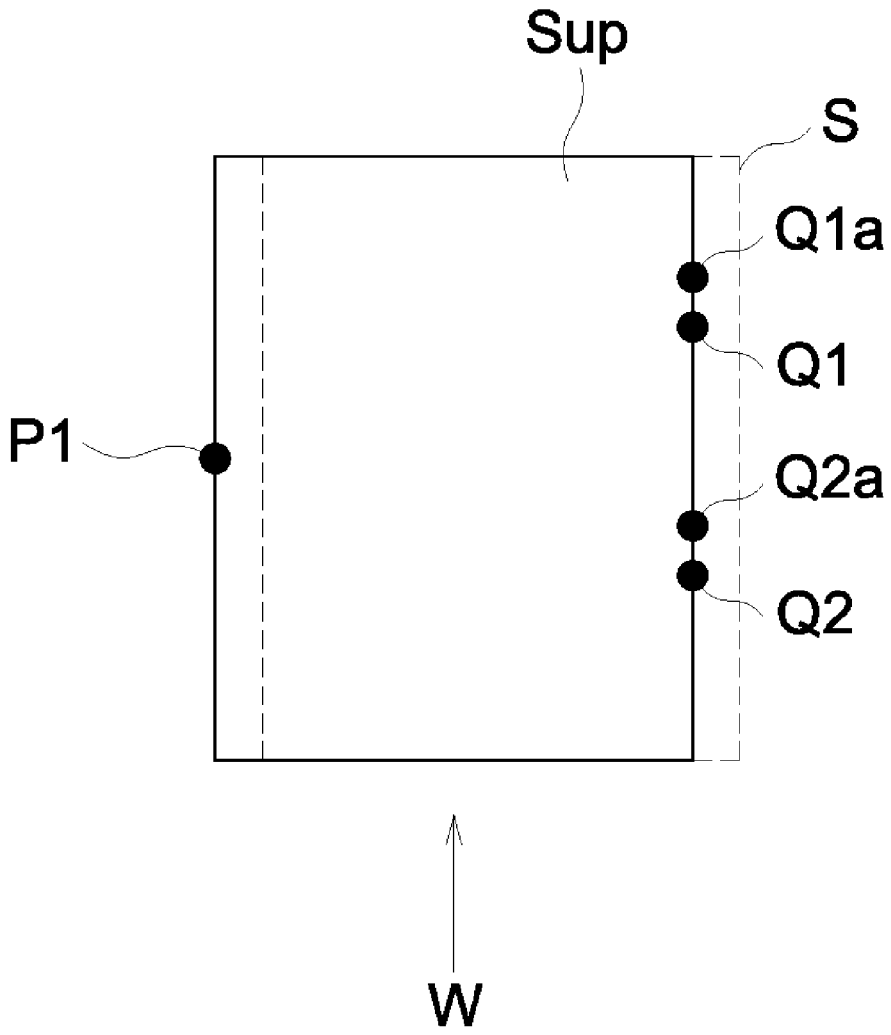
FIG. 9 is a diagram showing the aligning operation in an embodiment of the alignment member 101 (102) in the present invention.

FIG. 9 is a diagram showing the aligning operation in an embodiment of the alignment member 101 (102) in the present invention.

In FIG. 9, when the alignment member 102 comes in contact with and separates from the edge P1 of the sheet Sup to perform aligning operation, the alignment member 101 regulates the position at two different points in the sheet ejecting direction W. That is, the bottom end of the first alignment member 1011 regulates the position of the edge of the sheet Sup at point Q1 in FIG. 9, while the bottom end of the second alignment member 1012 regulates the position of the edge of the sheet Sup at point Q2 in FIG. 9.

In the present embodiment, the alignment member 101 is described as a structure keeping in contact with the two points of edge of the sheet Sup. If the alignment members 101 and 102 are designed to come in contact with only one edge point on each of the right and left of the sheet Sup, a problem will arise if the sheet is greatly curled. A curled sheet will cause a difference in the height at the positions of the alignment member 101 and alignment member 102 keeping in contact with the sheet edges. This, in turn, will cause a difference in the position of the alignment member 101 (or 102) keeping in contact with the sheet Sup in the sheet ejecting direction W. This problem results from the configuration wherein the alignment members 101 and 102 swing around the rotary axis AX. Because of this configuration, a change in the height of contact with the sheet Sup will cause a change in the position in the horizontal direction. If the alignment members 101 and 102 come in contact with the edge of the sheet Sup at only one position on each of the right and left side, the aligning operation may cause the sheet Sup to tilt to the right or left with respect to the sheet ejecting direction W, when there is a difference in the contact positions on the right and left sides.

In the present embodiment, even if the sheet bundle S on which the alignment member 101 is mounted is curled and the positions of the alignment member 101 regulating the sheet Sup are shifted to the positions Q1*a* and Q2*a*, the aforementioned problem does not occur, because there are two regulated positions as shown in FIG. 9.

In the present embodiment, even if a sheet is curled, the sheet is regulated in position with a high degree of accuracy, and the side end position of the sheet across the width can be aligned parallel in the sheet ejecting direction W.

Figure 10:
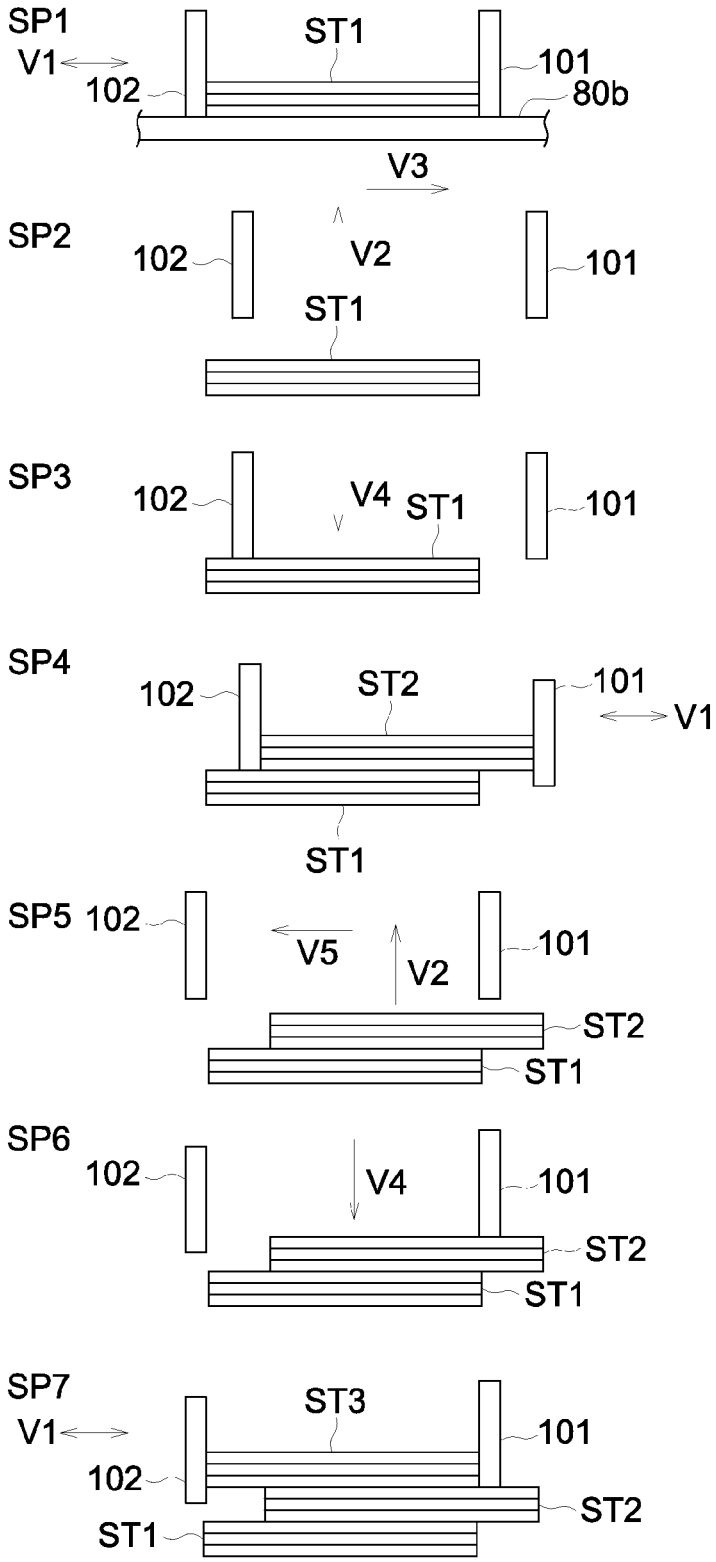
FIG. 10 is a schematic view showing the shift step and sheet alignment step implemented by the sheet alignment device 100 in the present invention.

Referring to FIG. 10, the following describes the shift control in the present embodiment:

FIG. 10 is a schematic view showing the shift steps and sheet alignment steps implemented by the sheet alignment device 100 in the present invention.

In FIG. 10, arrows V1, V3 and V5 indicate the sheet width direction of sheets. Sheet bundles ST1, ST2 and ST3 each constituting sheets of preset number for one unit of the shift are sequentially stacked on the elevation type sheet ejection tray 80*b*, such as a sheet bundle ST1 shown in Step SP1, sheet bundle ST2 shown in Step SP4 and sheet bundle ST3 shown in Step SP7.

In Step SP1, the alignment members 101 and 102 are set at the alignment height as the lower position denoted by a solid line of FIG. 6. This lower position is a position in which the bottom ends of the alignment members 101 and 102 are slightly lower than the stacking surface SS of the elevation type sheet ejection tray 80*b*. Accordingly, when the alignment members 101 and 102 are set at the lower position, they are placed on the elevation type sheet ejection tray 80*b* by its own weight. The alignment member 102 on the elevation type sheet ejection tray 80*b* performs a reciprocating motion across the width as shown by the arrow V1, whereby the sheet S is aligned. Sheets are aligned by the travel of the alignment member 102 every time one sheet S is ejected.

When the sheet number of the sheet bundle ST1 has reached the preset number according to the signal from the sheet sensor (not illustrated), both alignment members 101 and 102 are moved in the upward direction, as indicated by arrow V2 in Step SP2. In the process of upward travel indicated by arrow V2, it is not illustrated but each of the alignment members 101 and 102 make a slight travel toward the outside from the centerline across the width to form a clearance with sheets. After that, these alignment members travel upward as indicated by arrow V2. The traveling distance indicated by arrow V2 is such a distance that the bottom ends of the alignment members 101 and 102 are slightly away from the top surface of the sheet bundle ST1. The retraction position of the alignment members 101 and 102 is equivalent to the second retraction position of FIG. 6. The second retraction position is lower than the first retraction position (indicated by 101A and 102A) when the alignment members 101 and 102 are positioned, when the sheet ejection device 90 is suspended. Subsequent to the upward traveling, the alignment members 101 and 102 shift to the right (across the width) of FIG. 10 as shown by arrow V3. The traveling distance indicated by arrow V3 corresponds to the amount of sheet shift.

As shown in Step SP3, next the alignment members 101 and 102 travel downward as indicated by arrow V4. The alignment members 101 and 102 travel downward so that the bottom ends of the alignment members 102 comes in contact with the upper surface of the sheet bundle ST1 and the bottom ends of the alignment members 101 can be slightly lower than the top surface of the sheet bundle ST1.

In Step SP4, the alignment member 101 makes a reciprocating motion across the width as indicated by arrow V1, whereby the sheets are aligned.

Step SP5 is in the same stage as the Step SP2. After the alignment members 101 and 102 have traveled upward as indicated by arrow V2, they perform a horizontal travel to the left as indicated by arrow V5.

In Step SP6, after the alignment members 101 and 102 have performed a downward shift as indicated by arrow V4, and set at the alignment position shifted.

In the following Step SP7, the alignment member 102 performs a reciprocating motion in the direction of the arrow V1, whereby sheets S are aligned.

Sheet bundles ST1, ST2 and ST3 having been subjected to shift processing are formed in the alignment process of Steps SP1 through SP7.

Figure 11:
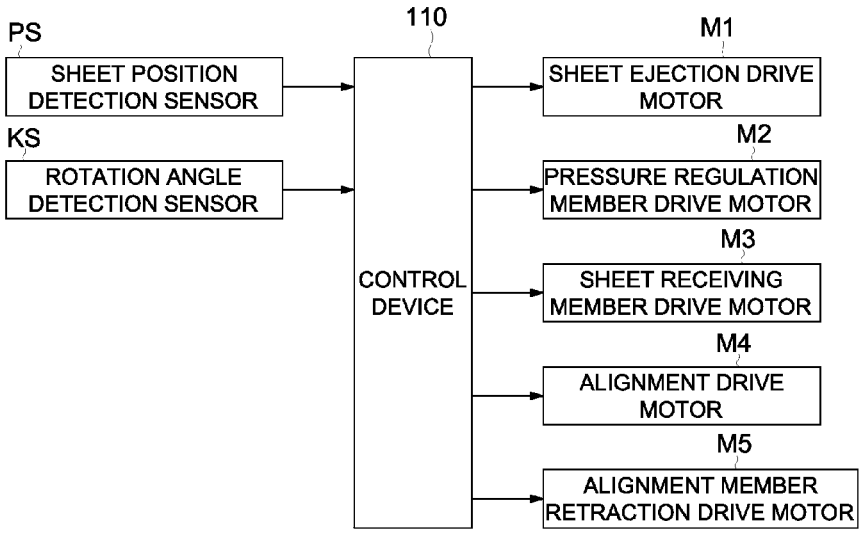
FIG. 11 is a block diagram showing the control of the control device 110 that controls the operation of the sheet ejection device 90 in the present invention.
Figure 12:
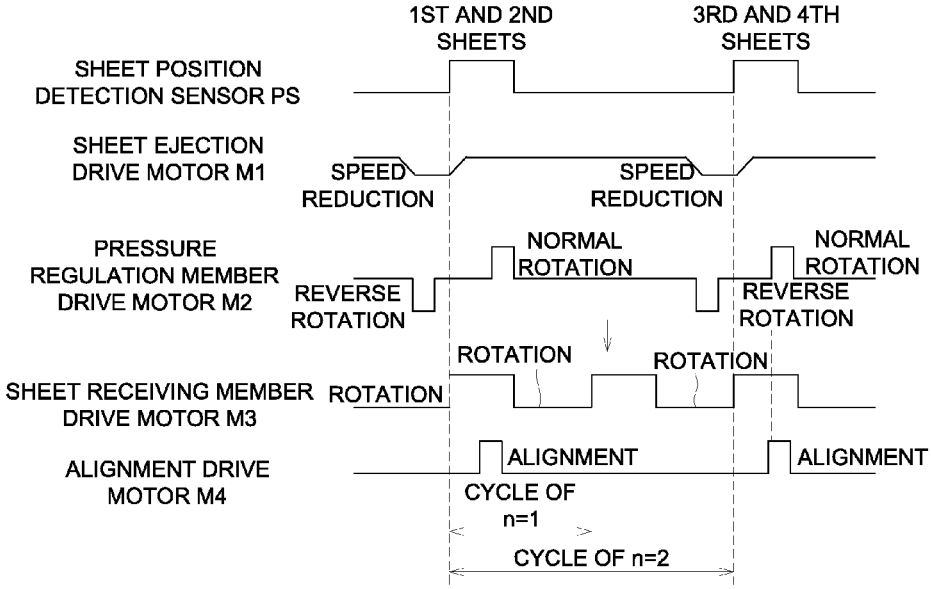
FIG. 12 is a timing chart showing the timing in the operation of the sheet ejection device 90 in the present invention.

FIG. 11 is a block diagram describing the flow of control of the control device 110 for controlling the operation of the sheet ejection device 90 according to the present invention. FIG. 12 is a timing diagram describing the operation timing of the sheet ejection device 90 according to the present invention.

In FIG. 11, receiving the signal from the sheet position detection sensor PS disposed upstream of the sheet ejection roller 80*a* in the sheet ejecting direction, the control device 110 controls the rotation of the sheet ejection roller 80*a* via the sheet ejection drive motor M1. Synchronizing the timing by a timer, not shown, driving the pressure regulation member drive motor M2 and the sheet receiving member drive motor M3, the control device 110 operates the pressure regulation member 92 and a pair of receiving member rotating plates 94, thereby operating the sheet pressure member 91 and the sheet receiving member 93 to move.

When the sheet S has been placed on the elevation type sheet ejection tray 80*b*, the control device 110 drives the alignment drive motor M4 and operates the alignment members 101 and 102 so that sheets S are aligned. Upon completion of a series of the operations of aligning the sheets S, the control device 110 drives the alignment member retraction drive motor M5 in response to the signal from the rotation angle detection sensor KS so that the alignment members 101 and 102 are moved from the alignment position to the first retraction position or second retraction position.

FIG. 12 is a timing chart showing the procedure when the sheets S1 and S2, placed one on top of the other, are ejected from the sheet ejection roller 80*a*. Symbol "n" denotes the number of ejected sheets. In the present embodiment, the region "n=2" of FIG. 12 represents one cycle. "n=1" represents the region in the case where the number of ejected sheets is one.

In FIG. 12, the sheet ejection drive motor M1 is driven by turning on the Start button (not illustrated) of the image forming apparatus B. After the first and second sheets S1 and S2, placed one on top of the other, have been detected by the sheet position detection sensor PS, the speed of the motor is reduced synchronizing with time of a timer. After the sheets S1 and S2 have been detected by the sheet position detection sensor PS, the pressure regulation member drive motor M2 makes a reverse rotation synchronizing the timing so that the pressure regulation member 92 is rotated in the counterclockwise direction, and restriction on the pressure of the sheet pressure member 91 against the sheet receiving member 93 is released. At the sheet holding position, the released sheet pressure member 91 holds the sheets S1 and S2 ejected from the sheet ejection roller 80*a*, and applies pressure to the sheet receiving member 93. After that, the sheet receiving member drive motor M3 is driven, and the sheet receiving member 93 is operated through the receiving member rotating plate 94. After the sheets S1 and S2 have been stacked on the elevation type sheet ejection tray 80*b*, the pressure regulation member drive motor M2 is driven in the normal direction, and the pressure regulation member 92 is driven in the clockwise direction. Then the sheet pressure member 91 is separated from the sheets S1 and S2 stacked on the elevation type sheet ejection tray 80*b*.

After that, the sheets S3 and S4 as a combination of the third and fourth sheets placed one on top of the other are conveyed. Similarly to the case of the sheets S1 and S2, the sheets S3 and S4 are detected by the sheet position detection sensor PS and the aforementioned steps are repeated.

When sheets are ejected one by one from the sheet ejection roller 80*a* on a continuous basis, the region of "n=1" corresponds to one cycle. Thus, the operations of the sheet position detection sensor PS, sheet ejection drive motor M1 and sheet receiving member drive motor M3 are additionally performed at the intermediate position of the region of "n=2". To be more specific, two sheets placed one on top of the other are conveyed in the intermediate conveyance unit C1. Accordingly, as compared to the case when one sheet is conveyed, the operations of each section include one spare cycle where no sheet is ejected.

In the present embodiment, the sheet receiving member drive motor M3 is driven (illustrated by an arrow in FIG. 12) during this one spare cycle to rotate only the sheet receiving member 93. To be more specific, in the region of "n=2", the sheet receiving member 93 is moved through the sheet receiving member drive motor M3 synchronously with the sheet ejection. After that, in the region of "n=1", the sheet receiving member 93 is moved during the aforementioned one spare cycle synchronously with the sheet ejection. This rotation of the sheet receiving member 93 allows the friction plate 97 to come in contact with the topmost sheet S on the elevation type sheet ejection tray 80*b*, and moves the sheet S in the direction reverse to the sheet ejecting direction. This operation permits the trailing edge of the topmost sheet S to hit against the sheet trailing edge hitting section 80*c*, thereby enhancing the stacking of the sheet bundle ST on the elevation type sheet ejection tray 80*b*.

Further, simultaneously or immediately before the pressure regulation member drive motor M2 starts normal rotation, the alignment drive motor M4 in the present invention allows the alignment members 101 and 102 to come in contact with the side ends of the sheet S or align the sheet S, whereby the sheet S is prevented from being raised by following the sheet pressure member 91.

When the sheet ejection device 90 of the present invention is utilized, there is one spare cycle when no sheet is ejected, if plural sheets are ejected placed one on top of the other. This provides a sufficient time for the process of post-processing such as sheet alignment process by the sheet alignment device 100, for example.

Further, use of the sheet ejection device 90 of the present invention reduces the time from the separation of the sheet S from sheet ejection roller 80*a*, to the stacking onto the elevation type sheet ejection tray 80*b*, and stabilizes this operation. This provides an advantage of ensuring a sufficient time for post-processing.

According to the configuration of the embodiment of the present invention, sheet misalignment can be prevented when ejected sheets are being stacked on the sheet stacking section, and misalignment of the already stacked sheets can also be prevented. Further, this arrangement reduces the time for stacking of the ejected sheets on the sheet stacking section and stabilizes the stacking operation.

In the present embodiment, the sheet ejection device of the present invention is arranged outside the post-processing apparatus C. It goes without saying that the present invention applies to a sheet ejection device outside the image forming apparatus B or a sheet reservoir section (intermediate stacker) which is placed inside the image forming apparatus B or post-processing apparatus C.

What is claimed is:

1. A sheet ejection device comprising:

a sheet stacking section for stacking sheets ejected one by one or ejected in a form of a plurality of sheets placed one on top of another from an ejecting device;

a sheet trailing edge hitting section, against which a trailing edge in a sheet ejecting direction of a sheet stacked on the sheet stacking section is hit;

a pair of sheet holding members for holding a sheet ejected one by one or the plurality of sheets placed one on top of another at a sheet holding position, and moving the sheet or the sheets to a sheet stacking position of the sheet stacking section;

a sheet holding member moving device for moving the pair of sheet holding members from the sheet holding position to the sheet stacking position; and a friction member which is provided on one of the pair of the sheet holding members and which comes in contact with an uppermost sheet stacked on the sheet stacking section, wherein, when the pair of sheet holding members reach the sheet stacking position after holding the sheet or the sheets at the sheet holding position, the sheet holding member moving device moves the one of the sheet holding members in a direction opposite to the sheet ejecting direction so that the sheet or the sheets held by the pair of sheet holding members are moved in a direction opposite to the sheet ejecting direction and a trailing edge of the sheet or trailing edges of the sheets in the sheet ejecting direction are hit against the sheet trailing edge hitting section, and the friction member comes in contact with the uppermost sheet already stacked on the sheet stacking section so that the uppermost sheet is biased toward the sheet trailing edge hitting section located upstream in the sheet ejecting direction.

2. The sheet ejection device of claim 1, wherein the sheet stacking section can move in a vertical direction, and lowers according to a number of sheets stacked on the sheet stacking section, the sheets including the sheet ejected one by one or the sheets ejected in the form of a plurality of sheets placed one on top of another from the ejecting device so as to keep a constant height of an upper surface of the stacked sheets.

3. The sheet ejection device of claim 1, wherein the pair of sheet holding members comprises:

a sheet receiving member as one of the sheet holding members;

a sheet pressure member which is supported swingably as another of the sheet holding members; and a pressure device for pressing the sheet pressure member against the sheet receiving member, wherein before the sheet ejected one by one or the sheets ejected in the form of a plurality of sheets placed one on top of another reaches the sheet holding position, the sheet receiving member stands by at the sheet holding position and the sheet pressure member stands by at a retraction position which is located at a distance from the sheet holding position, and wherein in synchronization with an arrival at the sheet holding position of the sheet ejected one by one or the sheets ejected in the form of a plurality of sheets placed one on top of another, the sheet pressure member pressed by the pressure device moves from the retraction position to the sheet holding position to hold a rear end portion of the sheet or the sheets, together with the sheet receiving member, and the sheet holding member moving device moves the sheet receiving member from the sheet holding position to the sheet stacking position, and then the sheet pressure member moves by following the sheet receiving member while holding the sheet or the sheets in the form of a plurality of sheets placed one on top of another.

4. The sheet ejection device of claim 3, wherein when the sheet holding member moving device moves the sheet receiving member to the sheet stacking position, the sheet receiving member, after hitting a trailing edge of the sheet ejected one by one or trailing edges of the sheets ejected in the form of a plurality of sheets placed one on top of another, against the sheet trailing edge hitting section, moves to a position which is at a distance from the sheet pressure member, and then the sheet pressure member presses the sheet ejected one by one or the sheets ejected in the form of a plurality of sheets placed one on top of another, against the sheet stacking section by pressure of the pressure device, and further subsequently, the sheet pressure member is moved to the retraction position and the sheet receiving member is moved to the sheet holding position.

5. The sheet ejection device of claim 1, wherein the sheets ejected in the form of a plurality of sheets placed one on top of another are two sheets.

6. The sheet ejection device of claim 1, wherein a friction coefficient of a sheet holding surface of the one of sheet holding members is greater than a friction coefficient between the sheets ejected in the form of a plurality of sheets placed one on top of another.

7. The sheet ejection device of claim 1 wherein a friction coefficient of a sheet contacting surface of the friction member is greater than a friction coefficient between a plurality of sheets on the sheet stacking section.

8. The sheet ejection device of claim 1 wherein a sheet contacting surface of the friction member which comes in contact with the uppermost sheet stacked on the sheet stacking section is movable with respect to the one of the pair of sheet holding members.

9. The sheet ejection device of claim 1 wherein when the sheets are ejected in the form of a plurality of sheets placed one on top of another from the ejecting device, the sheet holding member moving device moves the one of the sheet holding members from the sheet holding position to the sheet stacking position while holding the sheets in synchronization with an ejection of the sheets and then can further move the one of the sheet holding members from the sheet holding position to the sheet stacking position continuously in synchronization with timing of an ejection of one sheet.

10. The sheet ejection device of claim 1, further comprising:

a sheet alignment device which aligns edge positions of sheets in a direction perpendicular to the sheet ejecting direction, the sheets including the sheet ejected one by one or the sheets ejected in the form of a plurality of sheets placed one on top of another to be stacked at the stacking position or a sheet which has already been stacked in the sheet stacking section.

11. A post-processing apparatus comprising:

a post-processing section for post-processing a sheet; and the sheet ejection device of claim 1 for ejecting the sheet which has been post-processed.

12. An image forming system comprising:

an image forming section for forming an image on a sheet; and the post-processing apparatus of claim 11 for post-processing and ejecting the sheet on which an image has been formed.

* * * * *